US012628962B2

(12) United States Patent
Li

(10) Patent No.: US 12,628,962 B2
(45) Date of Patent: May 19, 2026

(54) MULTI-LAYER AND MULTI-CHAMBER INFLATABLE MATTRESS

(71) Applicant: WangLi Plastic & Electronics (Huizhou) Co., Ltd., Huizhou (CN)

(72) Inventor: Yonghe Li, Huizhou (CN)

(73) Assignee: WangLi Plastic & Electronics (Huizhou) Co., Ltd., Huizhou (CN)

( * ) Notice: Subject to any disclaimer, the term of this patent is extended or adjusted under 35 U.S.C. 154(b) by 48 days.

(21) Appl. No.: 18/673,447

(22) Filed: May 24, 2024

(65) Prior Publication Data

US 2025/0221545 A1 Jul. 10, 2025

(30) Foreign Application Priority Data

Jan. 10, 2024 (CN) ..... 202410040138.8

(51) Int. Cl.
*A47C 27/08* (2006.01)
*A47C 27/10* (2006.01)

(52) U.S. Cl.
CPC ..... *A47C 27/087* (2013.01); *A47C 27/082* (2013.01); *A47C 27/10* (2013.01); *A47C 27/081* (2013.01)

(58) Field of Classification Search
CPC ... A47C 27/087; A47C 27/083; A47C 27/082; A47C 27/081; A47C 27/08; A47C 27/10; A61G 7/05769; A61G 7/05776
USPC ..... 5/710–713, 706, 644, 655.3, 654
See application file for complete search history.

(56) References Cited

U.S. PATENT DOCUMENTS 2,703,770 A * 3/1955 Melzer ..... B29C 66/1312 156/289
3,030,640 A * 4/1962 Gosman ..... A47C 27/087 441/127
4,225,989 A * 10/1980 Corbett ..... A61G 7/05776 5/713
5,044,030 A * 9/1991 Balaton ..... A47C 27/081 5/687
6,546,580 B2 * 4/2003 Shimada ..... A61G 7/05776 5/713
6,568,011 B2 * 5/2003 Fisher ..... A47C 27/087 5/711

(Continued)

FOREIGN PATENT DOCUMENTS

CN 117752193 A * 3/2024 ..... A47C 27/087
CN 222194598 U * 12/2024

(Continued)

*Primary Examiner* — Robert G Santos
(74) *Attorney, Agent, or Firm* — MUNCY, GEISSLER, OLDS & LOWE, P.C.

(57) ABSTRACT

A multi-layer and multi-chamber inflatable mattress includes a mattress body enclosed by a top panel, a surrounding band and a bottom panel. The top panel includes a first layer and a second layer laid below the first layer. At least one of the first layer and the second layer is joined to the surrounding band, and the first layer is joined to the second layer to form a plurality of face-side chambers. The top panel is multi-layered with the multi layers formed a plurality of chambers, such chambers are in direct contact with human bodies when in use, which thus can improve comfort performance of the mattress, thereby improving sleep quality of users and experience of using.

17 Claims, 29 Drawing Sheets

(56) References Cited

U.S. PATENT DOCUMENTS 7,353,555 B2 * 4/2008 Lau ..... A47C 27/081 5/711
7,406,735 B2 * 8/2008 Lin ..... A47C 27/081 5/711
7,591,036 B2 * 9/2009 Lin ..... A47C 27/081 5/713
7,636,970 B2 * 12/2009 Lin ..... A47C 27/081 5/713
9,247,827 B2 * 2/2016 Lin ..... A47C 27/081
10,398,235 B2 * 9/2019 Lin ..... A47C 27/10
10,687,633 B2 * 6/2020 Liu ..... A47C 27/087
11,311,115 B2 * 4/2022 Gao ..... A47C 27/081
11,564,505 B2 * 1/2023 Liu ..... A47C 27/087
11,583,099 B2 * 2/2023 Li ..... A47C 27/10
11,641,948 B2 * 5/2023 Huang ..... A47C 27/087 5/706
11,910,930 B2 * 2/2024 Shi ..... F16K 31/53
11,937,703 B2 * 3/2024 Shi ..... A47C 27/082
12,108,880 B2 * 10/2024 Shi ..... A47C 27/082
12,364,340 B2 * 7/2025 Liu ..... A47C 27/081
12,453,428 B2 * 10/2025 Li ..... A47C 27/087
2002/0050010 A1 * 5/2002 Shimada ..... A61G 7/05776 5/706
2002/0083528 A1 * 7/2002 Fisher ..... A47C 27/081 5/710
2007/0124864 A1 * 6/2007 Lau ..... A47C 27/081 5/711
2007/0283499 A1 * 12/2007 Lin ..... A47C 27/081 5/713
2008/0209642 A1 * 9/2008 Lin ..... A47C 27/087 5/713
2008/0209643 A1 * 9/2008 Lin ..... A47C 27/081 5/713
2008/0256717 A1 * 10/2008 Austen ..... A47C 27/082 5/709
2015/0201760 A1 * 7/2015 Lin ..... A47C 27/087 5/710
2016/0183692 A1 * 6/2016 Lin ..... A47C 27/081 5/710
2017/0196368 A1 * 7/2017 Liu ..... A47C 27/081
2017/0215599 A2 * 8/2017 Lin ..... A47C 27/10
2020/0315366 A1 * 10/2020 Liu ..... A47C 27/081
2021/0378412 A1 * 12/2021 Gao ..... A47C 19/022
2022/0125212 A1 * 4/2022 Huang ..... A47C 27/081
2022/0202198 A1 * 6/2022 Li ..... A47C 27/087
2023/0098052 A1 * 3/2023 Shi ..... A47C 27/082 5/706
2023/0122867 A1 * 4/2023 Liu ..... A47C 27/16 5/709
2023/0218091 A1 * 7/2023 Shi ..... F16K 31/53 5/710
2024/0016303 A1 * 1/2024 Shi ..... A47C 27/082
2024/0016304 A1 * 1/2024 Li ..... A47C 27/082
2024/0298813 A1 * 9/2024 Shi ..... A47C 27/087
2025/0221545 A1 * 7/2025 Li ..... A47C 27/082

FOREIGN PATENT DOCUMENTS

EP 3078301 A1 * 10/2016 ..... A47C 27/087
EP 3078301 B1 * 3/2020 ..... A47C 27/10

* cited by examiner

F

MULTI-LAYER AND MULTI-CHAMBER INFLATABLE MATTRESS

CROSS REFERENCE TO RELATED APPLICATIONS

The present application claims priority from Chinese Application No. CN 202410040138.8 filed on Jan. 10, 2024, all of which are hereby incorporated herein by reference.

TECHNICAL FIELD

The present invention relates to the field of inflatable products, and more particularly, relates to a multi-layer and multi-chamber inflatable mattress.

BACKGROUND

An inflatable mattress is a mattress with strong flexibility and elasticity, which is expanded to a larger volume after inflation. With the inflatable mattress, users can be in close fit with the bed, so that the cervical spine, lumbar spine, legs and wrists of users are no longer suspended, which thus can eliminate fatigue feeling of human bodies as soon as possible. In addition, the inflatable mattress is also very portable and can be folded up to a very small size, such as a pillow, so it can be folded up and placed in a locker when out of use, and can be taken out and filled with air when in use. With the advantage of portability and less area occupancy, the inflatable mattress can be placed indoors and outdoors at will, overcoming the defects that the traditional furniture exists, such as its bulkiness and larger area occupancy. People thus can use it when working outside, moving frequently, camping in the field, swimming, escorting or taking a temporary break from work. With its wide range of applications, demand for inflatable mattresses is increasingly growing.

A top panel of the existing inflatable mattresses on the market is generally formed by one layer of spread fabric, which cannot provide effective flexibility. Accordingly, flexibility of such inflatable mattress almost entirely depends on the inside chamber of the mattress body thereof, resulting in limited comfort and thus poor experience of users. It is therefore desirable to provide an inflatable mattress with improved flexibility and comfort.

SUMMARY

The present invention provides an inflatable mattress with multi-layer and multi-chamber structure, which has improved flexibility and comfort.

The multi-layer and multi-chamber inflatable mattress according to the present invention includes a mattress body enclosed by a top panel, a surrounding band, and a bottom pane, in which the top panel includes a first layer and a second layer laid below the first layer, at least one of the first layer and the second layer is joined to the surrounding band, and the first layer is joined to the second layer to form a plurality of face-side chambers.

In the present invention, the top panel serves to support human body, the surrounding band forms the side of the mattress, and the bottom panel is contacted with the ground when use. The first layer of the top panel is directly contacted with the human body. At least one of the first layer and the second layer is joined to the surrounding band, the first layer is joined to the second layer, for example, the first layer is joined to the surrounding band and the second layer is joined to the first layer; or the second layer is joined to the surrounding band and the first layer is joined to the second layer; or both the first layer and the second layer are joined to the surrounding band. In the present invention, each joint of the first layer and the second layer forms the edge of each face-side chamber. The plurality of face-side chambers thus form a plurality of elastic protrusion on the panel, making more comfortable for human body to lie on the mattress. Particularly, the first layer and the second layer form the plurality of face-side chambers through multipoint connection. The adjacent face-side chambers can be independent form each other or in air communication with each other.

Optionally, Material of the first layer may be flock/PVC or comfortable and breathable fabric/PVC. Material of the second layer and the third layer may be flock/PVC, PVC, TPU or formed by one of them bonding with a fabric. Material of the bottom layer may be PVC, TPU or formed by one of them bonding with a fabric.

According to the present invention, the top panel is multi-layered with the multi layers formed a plurality of chambers, such chambers are in direct contact with human bodies when in use, which thus can improve comfort performance of the mattress, thereby improving sleep quality of users and experience of using.

The face-side chambers in the present invention may include a plurality of first face-side chambers and second face-side chambers which are joined to each other.

In particular, the first face-side chambers are joined to the second face-side chambers, the first face-side chambers can be in air communication with each other or not. The first face-side chambers and second face-side chambers may have different size or shapes and uniformly distribute to form different shaped patterns on the top panel. Preferably, the first face-side chambers and the second face-side chambers are alternatively distributed, which makes the overall appearance of the mattress more pleasing.

Additionally, a third layer may be further included, which is joined to the second layer to form a rear-side chamber.

The second layer is preferably joined to the third layer by hot weld. Preferably, the edge of the third layer is joined to the second layer to form a single rear-side chamber. However, several rear-side chambers can be formed in the situation that the third layer includes several separate layers, and each separate layer is joined to the second layer to form one rear-side chamber.

The rear-side chamber is arranged under the face-side chambers, it thus can provide resilience for the face-side chambers especially when the face-side chambers are under pressure, which thus can further improve comfort performance of mattress. In addition, the rear-side chamber can replace the face-side chambers to provide support when the face-side chambers are in damage, conversely, the face-side chambers can continue to provide support when the rear-side chamber is in damage, such that avoiding being unable to use the mattress due to damage of the top panel. Therefore, the mattress according to the present invention is more convenient and applicable, especially for outside use.

A nature vent hole may be additionally provided at the rear-side chamber avoiding the plurality of face-side chambers, through which the rear-side chamber is in air communication with the outside of the mattress body. In such case, the area of the rear-side chamber is larger than the total area of all the plurality of face-side chambers.

The mattress may be provided with a nature vent hole or not. Through the nature vent hole the rear-side chamber is in communication with the outside of the mattress body, so that little air inside of the rear-side chamber can discharge therefrom through the nature vent hole when the rear-side chamber is compressed by the user laying on the top panel, which thus can avoid too rigidity for the top panel caused by too full air inside. Therefore, the nature vent hole can improve flexibility of the top panel. On the other hand, when out of use, air outside the mattress will be taken in the rear-side chamber 300 through the nature vent hole, so that the rear-side chamber can restore and full with air again, which forms natural adjustment. Such configuration thus can further improve comfortable performance of the mattress. Furthermore, with the nature vent hole automatically adjusting air amount inside the rear-side chamber, the mattress out of use can be folded for easy storage with less space.

In particular, the first layer is joined to the surrounding band, the edge of the second layer is joined to the edge of the third layer, the joint of the second layer and the third layer is extended towards the surrounding band to form an extending piece, so that the extending piece, the first layer, and the surrounding band are enclosed to form an upper edge air chamber. A bottom encircling piece may be further provided in a way that the bottom encircling piece, the bottom panel, and the surrounding band are enclosed to form a bottom edge air chamber.

Alternatively, the top panel is provided with an upper encircling piece, instead of the extending piece. In such case, the first layer, the upper encircling piece and the surrounding band are enclosed to form an upper edge air chamber, and the edge of the rear-side chamber is formed along the upper encircling piece.

As a further alternative, the first layer is joined to the surrounding band, the edge of the second layer is joined to the third layer, and the edge of the third layer is joined to the surrounding band, the upper encircling piece is provided inside the mattress body in a way that the upper encircling piece, the top panel and the surrounding band are enclosed to form an upper edge air chamber; and the plurality of face-side chambers are in air communication with each other, the third layer is provided with a layer vent hole, through which the plurality of face-side chambers are in air communication with the upper edge air chamber.

In this case, a bottom encircling piece is further provided, where the bottom encircling piece, the bottom panel, and the surrounding band are enclosed to form a bottom edge air chamber, both the upper encircling piece and the bottom encircling piece are provided with a through hole through which the upper edge air chamber and the bottom edge air chamber are in air communication with the inside of the mattress body.

In the present invention, a pump may be further provided at the surrounding band for inflating the mattress body.

In a case that the upper edge air chamber and the bottom edge air chamber are in air communication with the inside of the mattress body through holes, the pump can inflate the edge air chambers and the mattress body. In an alternative case, the pump is connected to each edge air chambers through at least one air passage, for example one, two or three air passages.

Particularly, the pump is connected with a first air passage and a second sir passage, such that the pump can be in air communication with the upper edge air chamber through the first air passage and in air communication with the bottom edge air chamber through the second sir passage.

DETAILED DESCRIPTION

Figure 1:
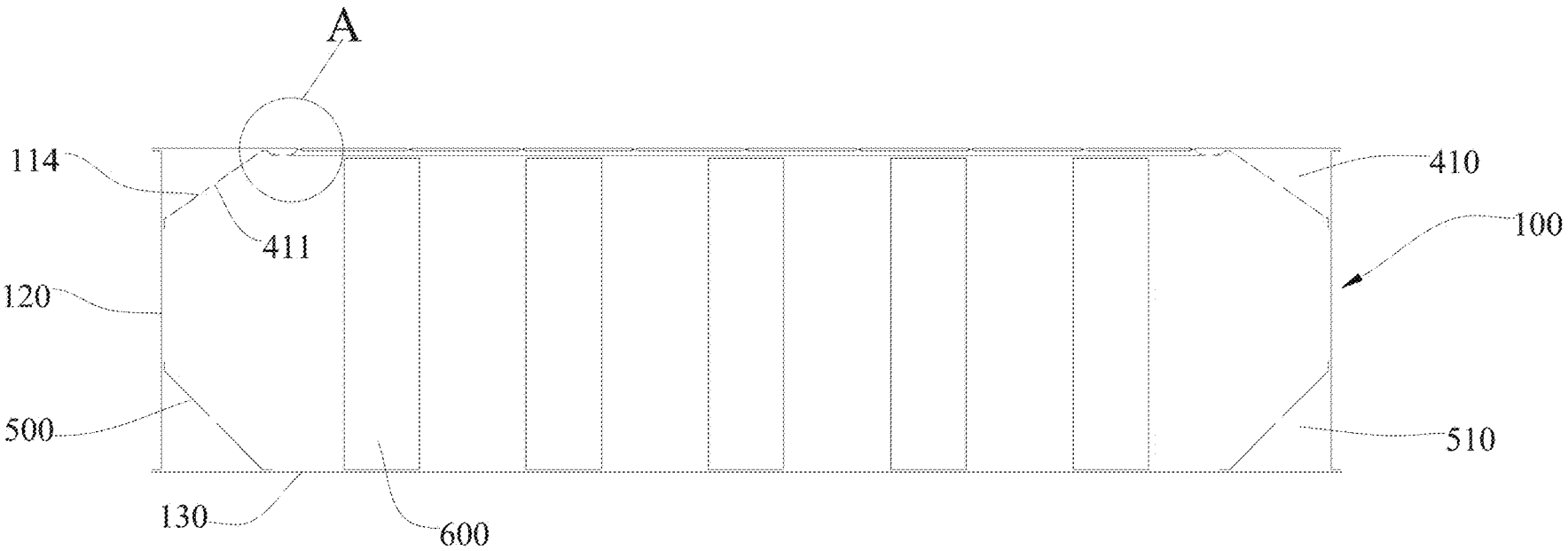
FIG. 1 is a cross-sectional view of an inflatable mattress along the length direction thereof according to an embodiment of the present invention.

The accompanying drawings of the present invention are for exemplary illustration only, and should not be construed as limitations on the present invention. In order to better illustrate the following embodiments, some parts in the accompanying drawings may be omitted, enlarged or reduced, and they do not represent the size of the actual product. For those skilled in the art, it is understandable that certain well-known structures in the drawings and descriptions thereof may be omitted.

FIGS. 1 to 4 illustrates a multi-layer and multi-chamber inflatable mattress according to an embodiment of the present invention, which includes a mattress body 100 enclosed by a top panel 110, a surrounding band 120, and a bottom panel 130. The top panel 110 in the present embodiment includes a first layer 111 and a second layer 112 laid below the first layer 111, at least one of the first layer 111 and the second layer 112 is joined to the surrounding band 120 by heat weld. It should be noted that in some embodiments, the first layer 111 is joined to the surrounding band 120 and the second layer 112 is joined to the first layer 111. In some embodiments, the second layer 111 is joined to the surrounding band 120 and the first layer 112 is joined to the second layer 111. In some embodiments, both the first layer 111 and the second layer 112 are joined to the surrounding band 120.

Figure 3:
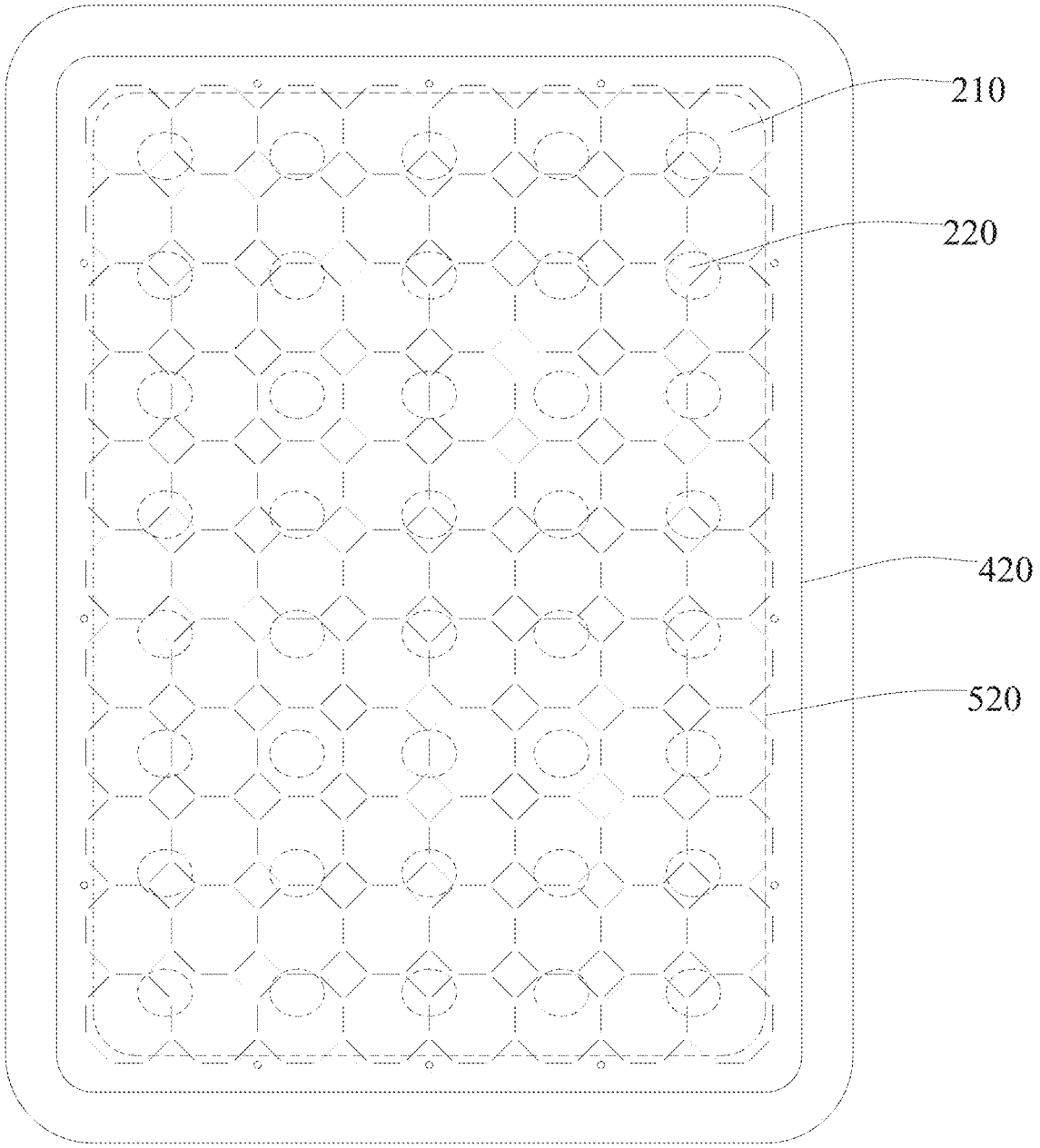
FIG. 3 is a top view of the inflatable mattress of FIG. 1.

In the present embodiment, the first layer 111 is joined to the second layer 112 by hot weld to form a plurality of face-side chambers 200, as shown in FIG. 3. The face-side chambers 200 includes a plurality of first face-side chambers 210 and second face-side chambers 220 which are distributed alternatively. In particular, the section of each first face-side chamber 210 on the top panel 110 is in form of an octagon, and the section of each second face-side chamber 220 on the top panel 110 is in form of a quadrilateral. In this case, from top view, the edges of each first face-side chamber 210 are alternatively connected with one second face-side chamber 220, or all edges of each second face-side chamber 220 are individually connected with one first face-side chamber 210.

In the present embodiment, the top panel 110 is multi-layered with the multi layers formed a plurality of chambers by hot weld, such chambers are in direct contact with human bodies when in use, which can improve comfort performance of mattress, thereby improving sleep quality of users and experience of using.

Figure 2:
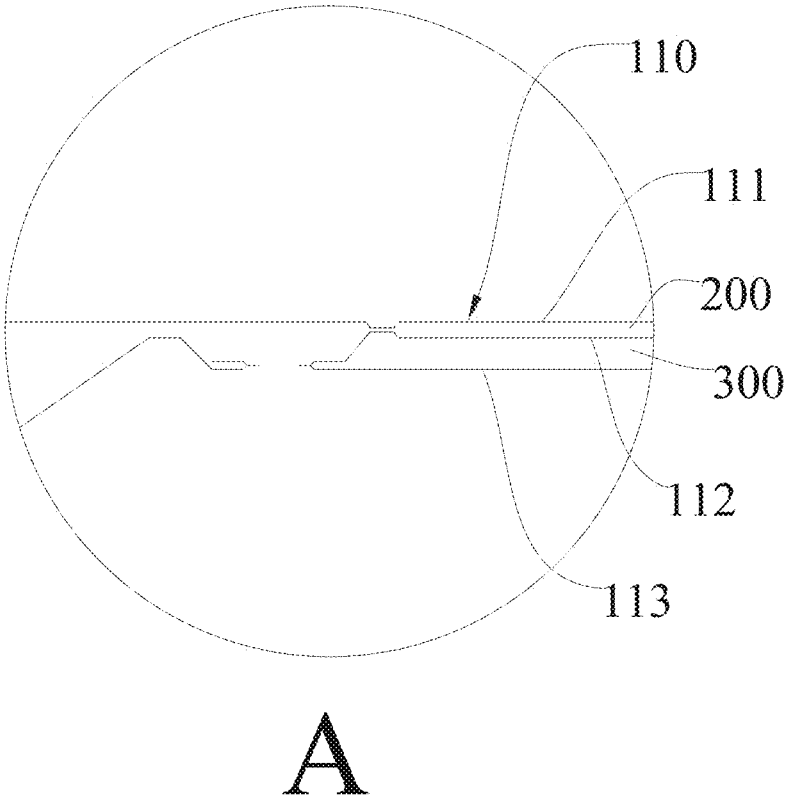
FIG. 2 is an enlarge view of detail A of FIG. 1.

A third layer 113 is further included, which is joined to the second layer 112 by hot weld to form a rear-side chamber 300, as shown in FIG. 2.

The rear-side chamber 300 can provide resilience for the face-side chambers 220 especially when the face-side chambers 220 are under pressure, which can further improve comfort performance of mattress. In addition, the rear-side chamber 300 can replace the face-side chambers 220 to provide support when the face-side chambers 220 are in damage, conversely, the face-side chambers 220 can continue to provide support when the rear-side chamber 300 is in damage, such that avoiding being unable to use the mattress due to damage of the top panel 110. Therefore, the mattress according to the present embodiment is more convenient and applicable, especially for outside use.

Figure 4:
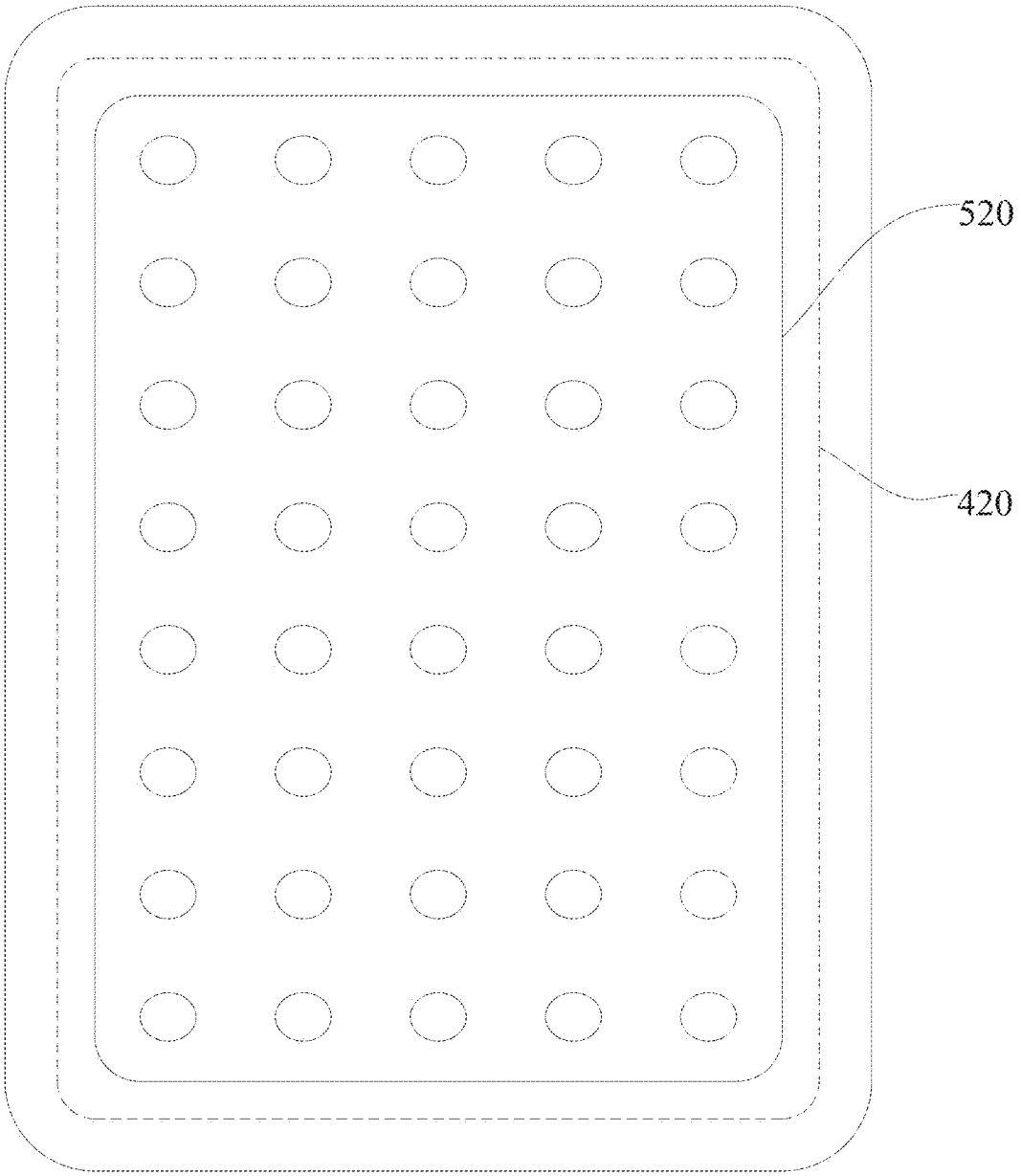
FIG. 4 is a bottom view of the inflatable mattress of FIG. 1.

In combination with FIG. 1 and FIG. 2, the first layer 111 is joined to the surrounding band 120, the edge of the second layer 112 is joined to the edge of the third layer 113, the joint of the second layer 112 and the third layer 113 extends towards the surrounding band 120 to form an extending piece 114, namely an upper encircling piece. In such case, the extending piece 114, the first layer 111, and the surrounding band 120 are enclosed to form an upper edge air chamber 410. The extending piece 114 in this embodiment is joined to the first layer 111 by hot weld to form a weld line 420, as shown in FIG. 3 and FIG. 4. The upper edge air chamber 410 will peripherally protrude from the top panel 110, which can prevent the user from falling off the mattress, thus improving safety.

A bottom encircling piece 500 can be further provided. In this embodiment, the bottom panel 130 is joined to the surrounding band 120 by hot weld, one side of the bottom encircling piece 500 is joined to the bottom panel 130 by hot weld to form a weld line 520, as shown in FIG. 3 and FIG. 4, and the other side thereof is joined to the surrounding band 120 by hot weld, so that the bottom encircling piece 500, the bottom panel 130, and the surrounding band 120 are enclosed to form a bottom edge air chamber 510.

Preferably, both the extending piece 114 and the bottom encircling piece 500 are individually provided a first through hole 411, so that the upper edge air chamber 410 and the bottom edge air chamber 510 are in air communication with the inside of the mattress body 100 through the first hole 411. Particularly, the width of the bottom encircling piece 500 is larger than the width of the extending piece 114, that is, the volume of the bottom edge air chamber 510 is larger than the volume of the upper edge air chamber 410, which can make the mattress stably gripping the ground and thus not prone to moving when in use.

According to a preferable embodiment, a plurality of drawing bands 600 are provided in the mattress body 100, with one end connected with the top panel 110 and the other end connected with the bottom panel 130. The drawing bands 600 can be in sheet shape or columnar shape. As shown in FIGS. 1 and 3-4, the drawing bands 600 in this embodiment are in columnar shape, the top end and the bottom end of each drawing band 600 are respectively joined to the top panel 110 and the bottom panel 130 to form a circular weld line.

Figure 5:
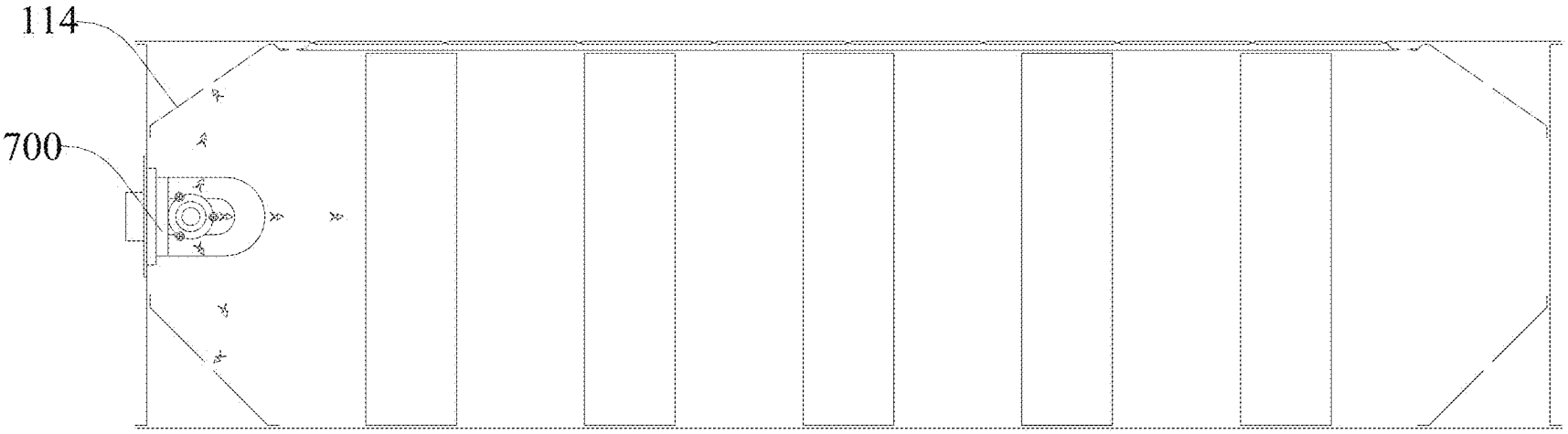
FIG. 5 is a cross-sectional view of an inflatable mattress along the length direction thereof according to an embodiment of the present invention.

According to a preferable embodiment, referring now to FIG. 5, a pump 700 is provided at least at one side of the surrounding band 120, which is configured to inflate the mattress body 100, the upper edge air chamber 410 and the bottom edge air chamber 510.

Figure 6:
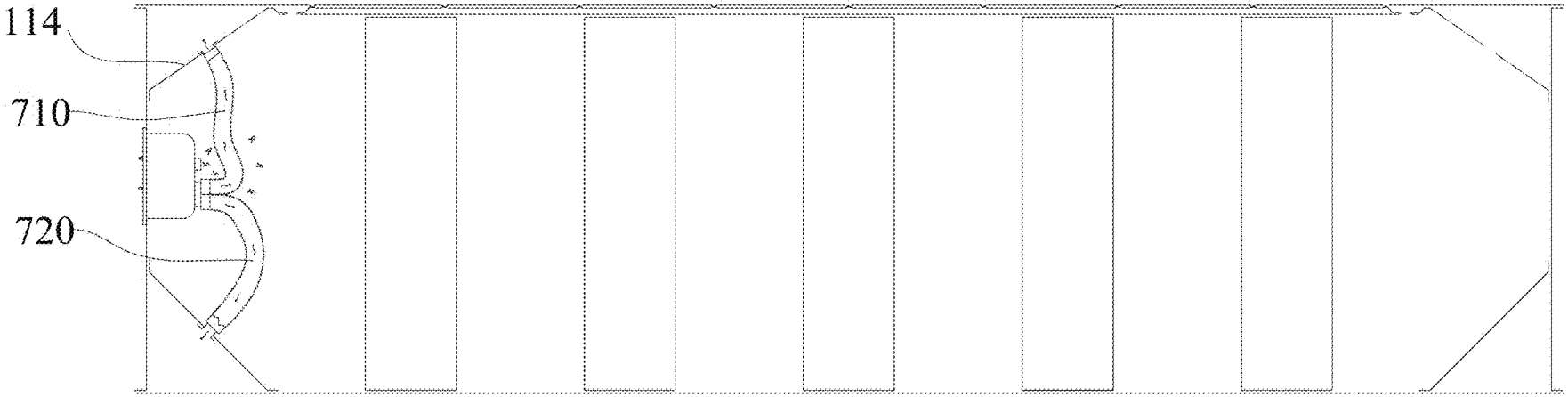
FIG. 6 is a cross-sectional view of an inflatable mattress along the length direction thereof according to an embodiment of the present invention.
Figure 7:
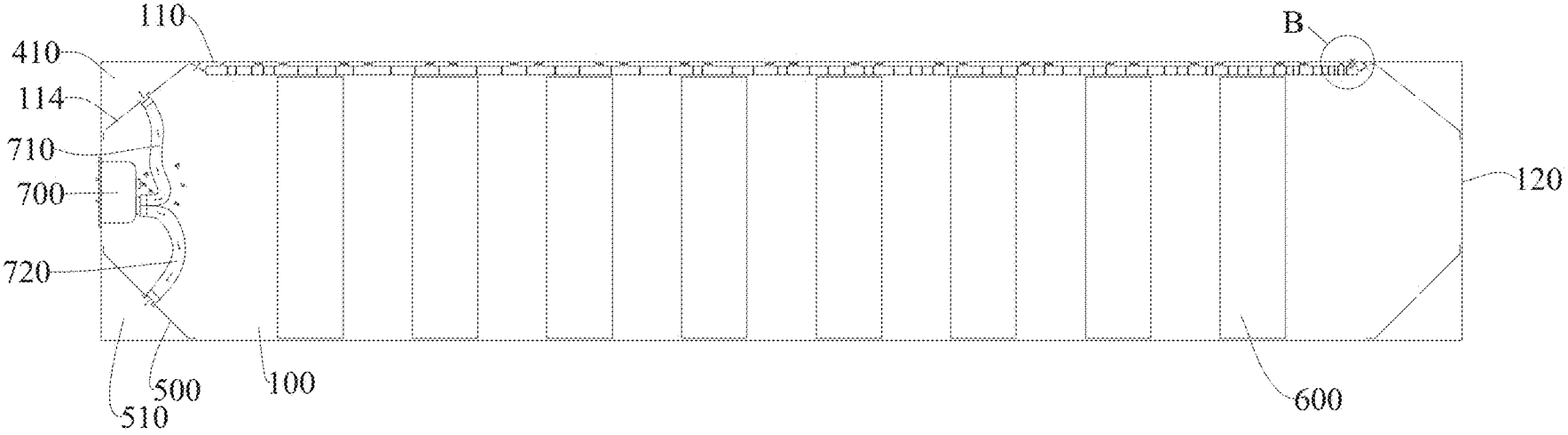
FIG. 7 is a cross-sectional view of an inflatable mattress along the length direction thereof according to an embodiment of the present invention.
Figure 8:
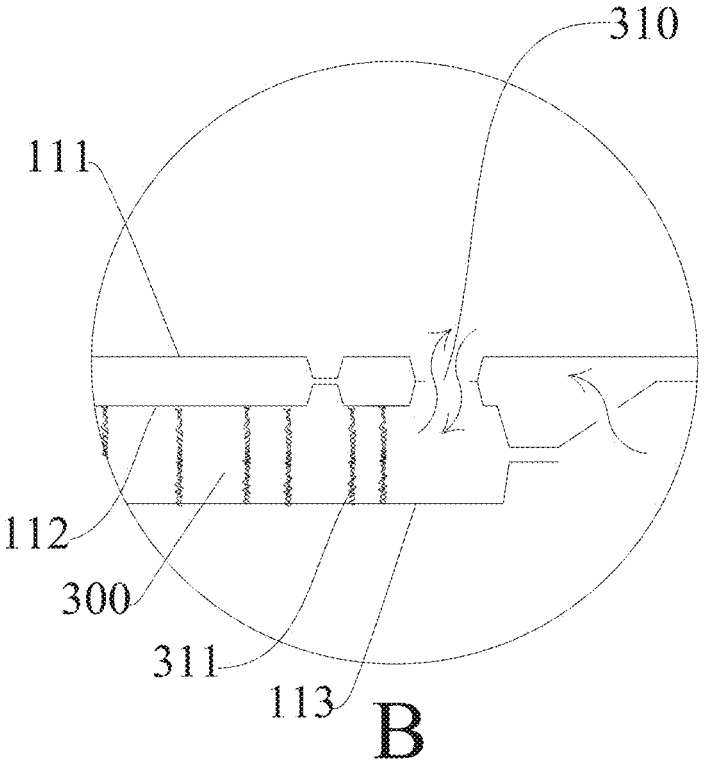
FIG. 8 is an enlarge view of detail B of FIG. 7.
Figure 9:
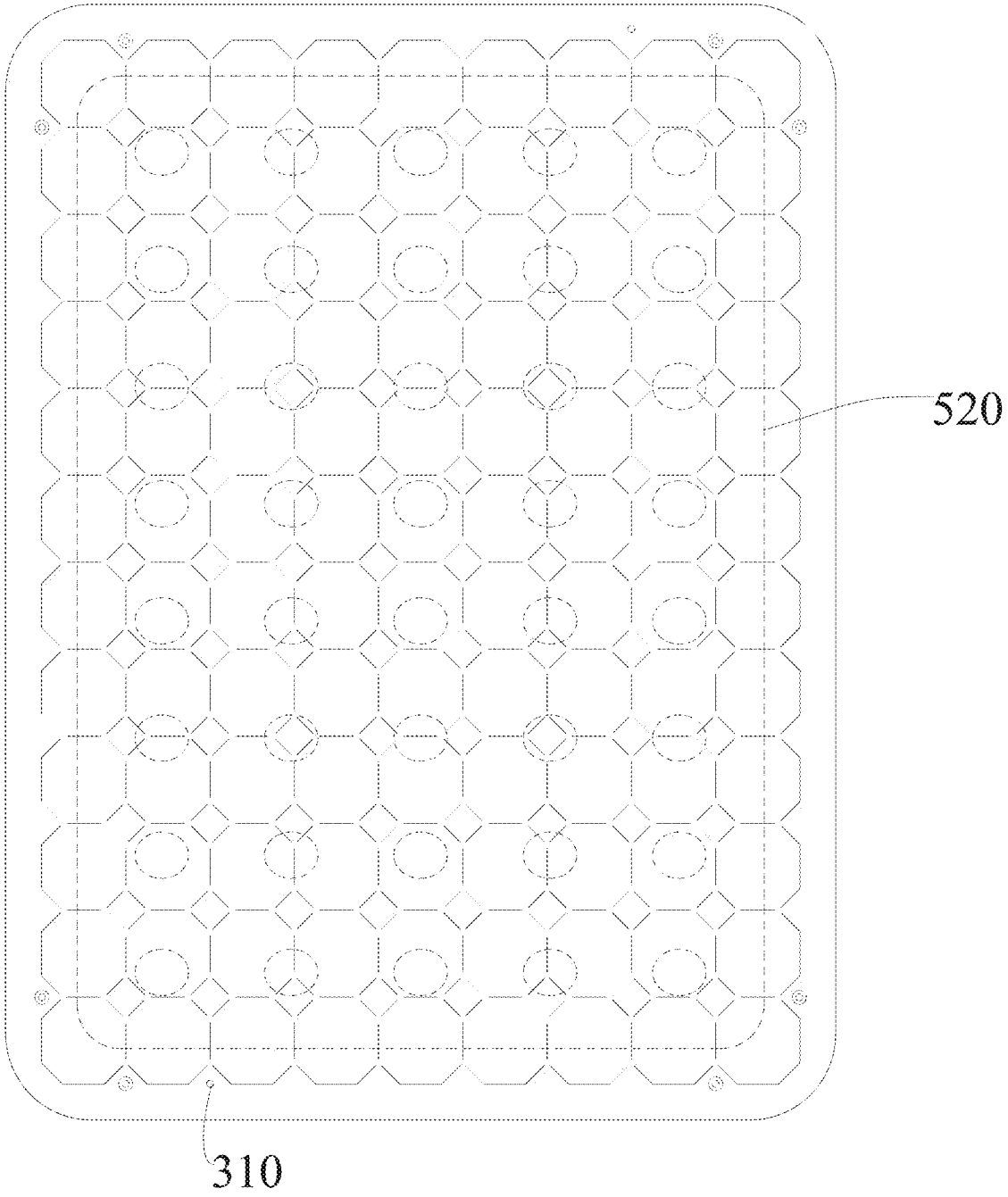
FIG. 9 is a top view of the inflatable mattress of FIG. 7.
Figure 10:
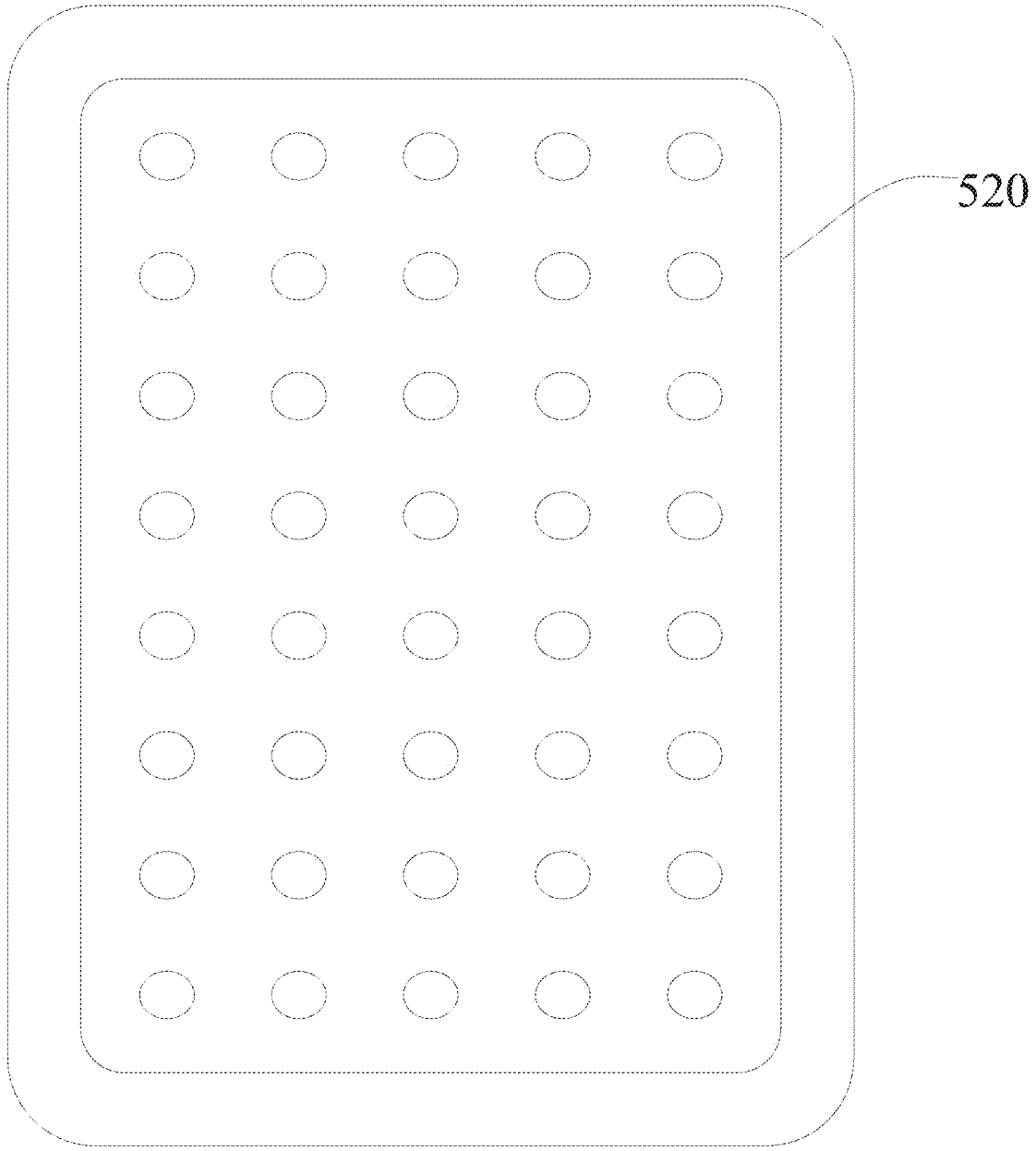
FIG. 10 is a bottom view of the inflatable mattress of FIG. 7.

With reference to FIG. 6, the pump 700 may be connected with a first air passage 710 and a second air passage 720 according to a preferable embodiment, such that the pump 700 can be in air communication with the upper edge air chamber 410 through the first air passage 710 and in air communication with the bottom edge air chamber 510 through the second air passage 720.

In such configuration, the upper edge air chamber 410 can be directly inflated by the pump 700 through the first air passage 710, similarly, the second sir passage 720 can be directly inflated by the pump 700 through the second sir passage 720. In such easy way, inflating efficiency can be effectively improved. Meanwhile, the two edge air chambers 510, 520 can be inflated much more fully, which forms better support hardness and collapse resistance, thereby improving shaping performance for the inflatable mattress and ensuring stable support thereof when in use.

The rear-side chamber 300 can be provided with a nature vent hole or not.

FIGS. 7 to 10 depict a multi-layer and multi-chamber inflatable mattress according to another embodiment. In this embodiment, a nature vent hole 310 (clearly illustrated in FIG. 8) is additionally provided at the rear-side chamber 300. In such case, the area of the rear-side chamber 300 is larger than the total area of all the face-side chambers 210, 220, and the nature vent hole 310 is particularly provided at a portion of the rear-side chamber 300 avoiding the face-side chambers 210, 220, such nature vent hole 310 allows the rear-side chamber 300 to be in air communication with the outside of the mattress body 100.

Additionally, a plurality of elastic elements 311 are provided in the rear-side chamber 300, with one end of each elastic element 311 connected to the second layer 112 and another end thereof connected to the third layer 113. The elastic elements 311 are preferably made of polyurethane fiber. Polyurethane fiber has high elasticity. The subject made of polyurethane fiber can usually extend 6 to 7 times of length. Besides, it can restore to initial state once tension has lost, which has high durability and easy-care property.

In this embodiment, the area of the rear-side chamber 300 is larger than the total area of all the face-side chambers 200, namely the area of the third layer 113 is larger than the total area of all the face-side chambers 200, and the rear-side chamber 300 is in communication with the outside of the mattress body 100 through the nature vent hole 310, so that little air inside of the rear-side chamber 300 can discharge therefrom through the nature vent hole 310 when the rear-side chamber 300 is compressed by the user laying on the top panel 110, which thus can avoid too rigidity for the top panel 110 caused by too full air inside. Therefore, the nature vent hole 310 can improve flexibility of the top panel 110. On the other hand, when out of use, air outside the mattress will be taken in the rear-side chamber 300 through the nature vent hole 310, so that the rear-side chamber 300 can restore and full with air again, which forms natural adjustment. Meanwhile, the elastic elements 311 are tensioned to strict expansion degree of the rear-side chamber 300, thereby avoiding pulling force of the elastic elements 311 caused by too expansion. In addition, elastic expansion allowance of the elastic elements 311 can avoid pulling force between the second layer 112 and the third layer 113, further reducing damage to the mattress. Such configuration of the present embodiment thus further improves flexibility of the mattress. Furthermore, with the nature vent hole 310 automatically adjusting air amount inside the rear-side chamber 300, the mattress out of use can be folded for easy storage with less space.

Figure 11:
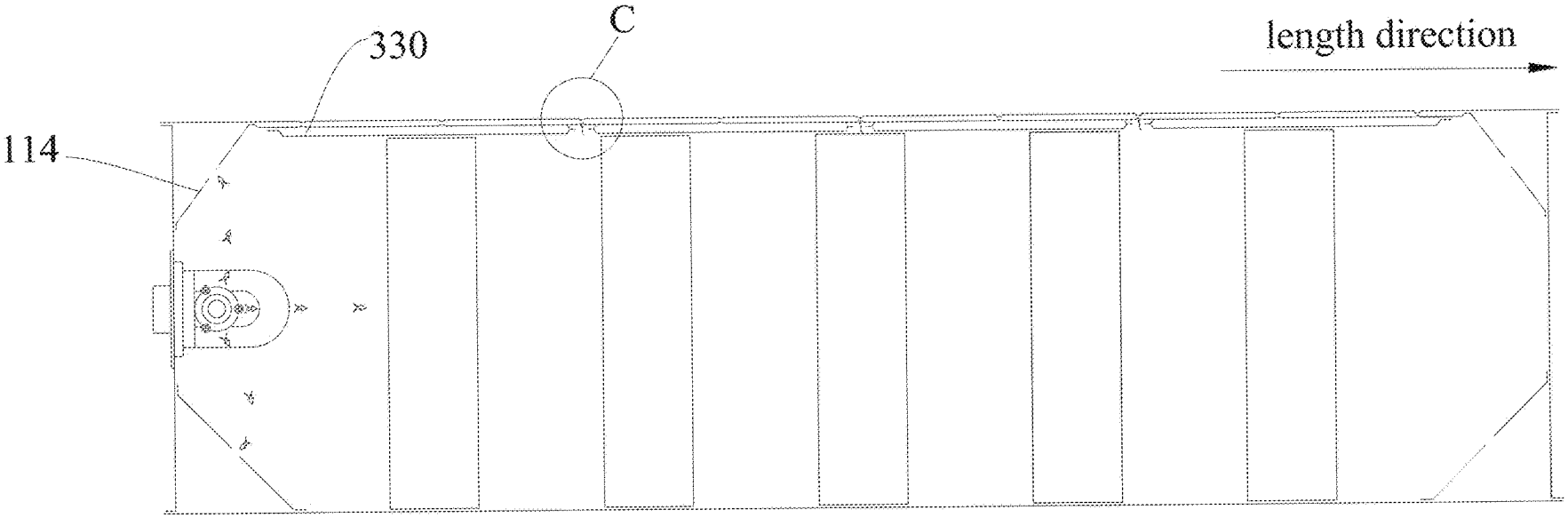
FIG. 11 is a cross-sectional view of an inflatable mattress along the length direction thereof according to an embodiment of the present invention.
Figure 12:
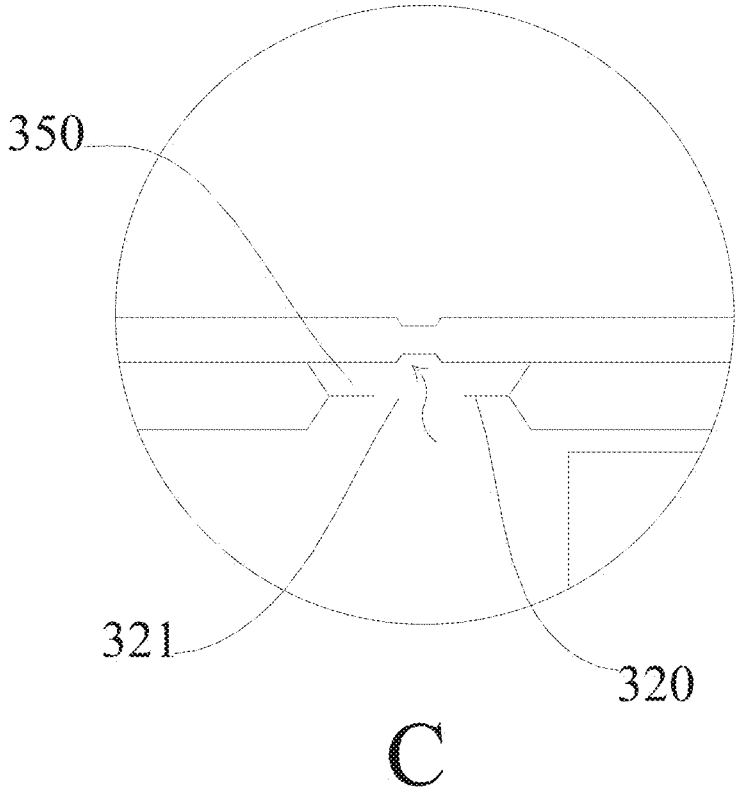
FIG. 12 is an enlarge view of detail C of FIG. 11.

Referring now to FIG. 11, the third layer 113 in this embodiment is formed by several separate layers 330, and each separate layer 330 is joined to the second layer 112 to form one rear-side chamber 300. That is, in this embodiment multiple rear-side chambers 300 are provided. The cross section of each rear-side chamber 300 is in form of rectangle. The rear-side chamber 300 extends along the width direction of the mattress. The length direction of the mattress is shown in FIG. 11 and the width direction is perpendicular to the length direction in the plane where the top panel 110 is located. In combination with FIG. 12, the adjacent rear-side chambers 300 are joined each other by a welding piece 320. A connecting chamber 350 is further formed by the welding piece 320 and the second layer 112. The connecting chamber 350 is provided with a hole 321, through which the connecting chamber 350 is in air communication with the inside of the mattress body 100.

Figure 13:
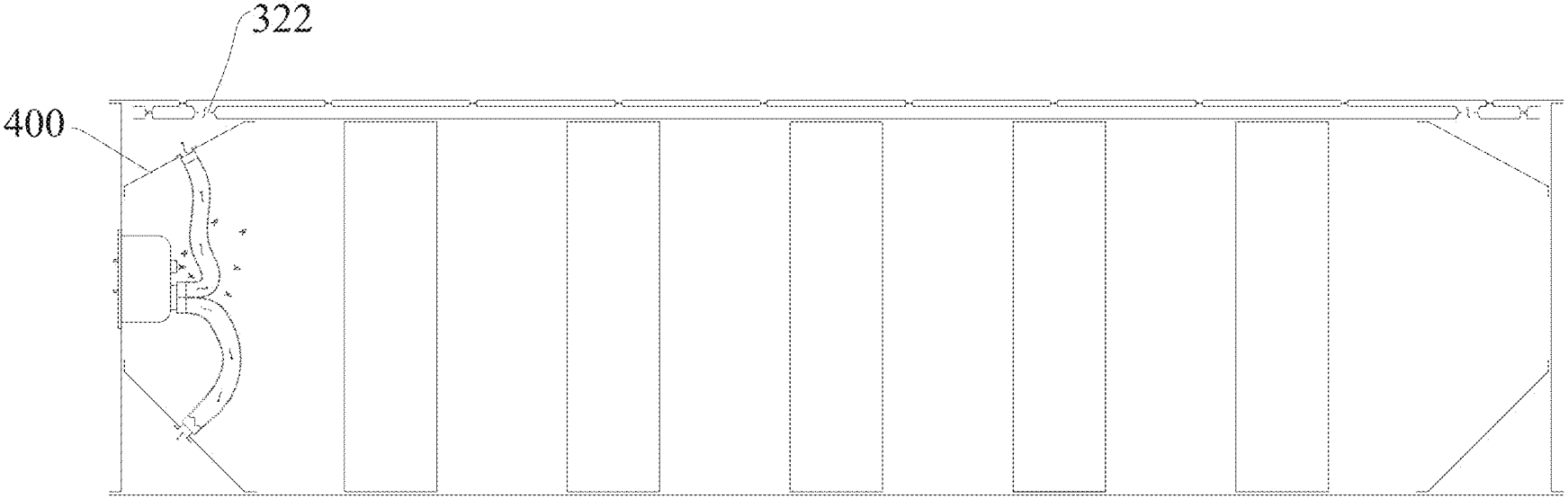
FIG. 13 is a cross-sectional view of an inflatable mattress along the length direction thereof according to an embodiment of the present invention.

FIG. 13 shows a multi-layer and multi-chamber inflatable mattress according to an embodiment. In this embodiment, the first layer 111 is joined to the surrounding band 2 and the second layer 112 is joined to the first layer 111 by hot weld to form a plurality of face-side chambers 200. The face-side chambers 200 are in air communication each other. An upper encircling piece 400 is further provided, instead of the extending piece 114, with one side of the upper encircling piece 400 joined to the third layer 113 and the other opposite side joined to the surrounding band 120. The upper encircling piece 400, the third layer 113 and the surrounding band 120 are enclosed to form the upper edge air chamber 410. The rear-side chamber 300 extends to the inside of the upper edge air chamber 410 and close to the surrounding band 120. In this embodiment, the third layer 113 is formed by several separate layers 330, and each separate layer 330 is joined to the second layer 112 to form one rear-side chamber 300.

Particularly, three rear-side chambers 300 are provided in this embodiment, in which both ends of the middle rear-side chamber 300 extend to the inside of the upper edge air chamber 410. The adjacent rear-side chambers 300 are connected each other by a welding piece 320 (referring to FIG. 12). The welding piece 320 is provided with a hole 322, through which the upper edge air chamber 410 is in air communication with the face-side chamber 200. In such configuration, air in the upper edge air chamber 410 can directly flow into the face-side chamber 200 through the side corner close to the surrounding band 120 and can also through the hole 322, thus further improving inflating efficiency.

Figure 14:
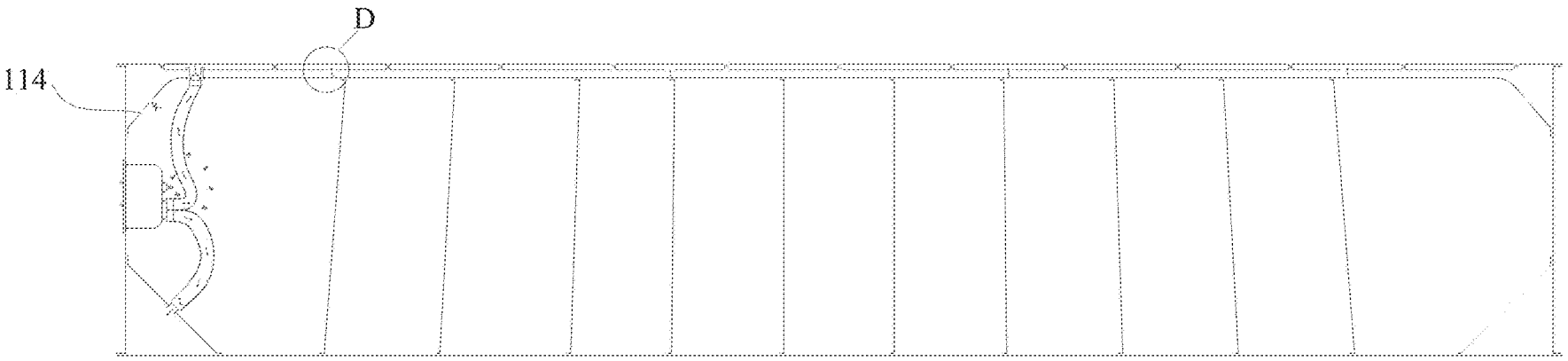
FIG. 14 is a cross-sectional view of an inflatable mattress along the length direction thereof according to an embodiment of the present invention.
Figure 15:
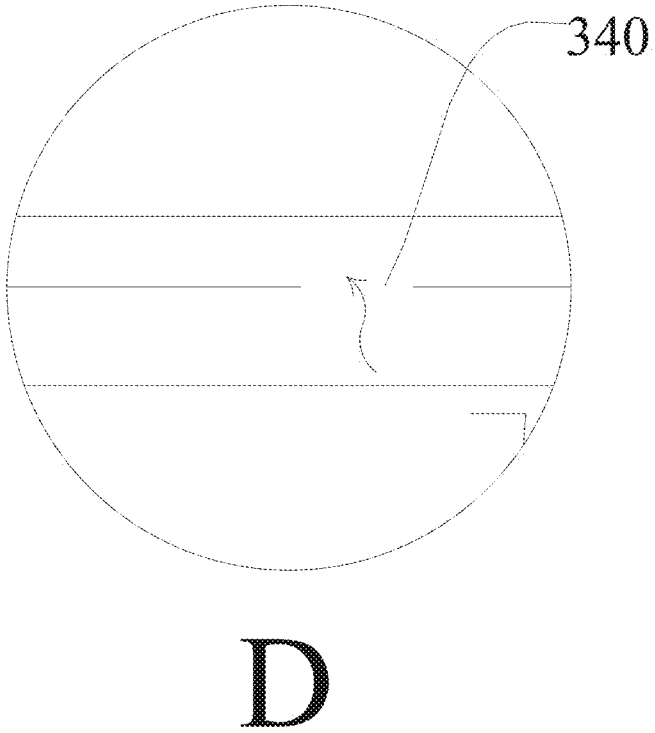
FIG. 15 is an enlarge view of detail D of FIG. 11.
Figure 16:
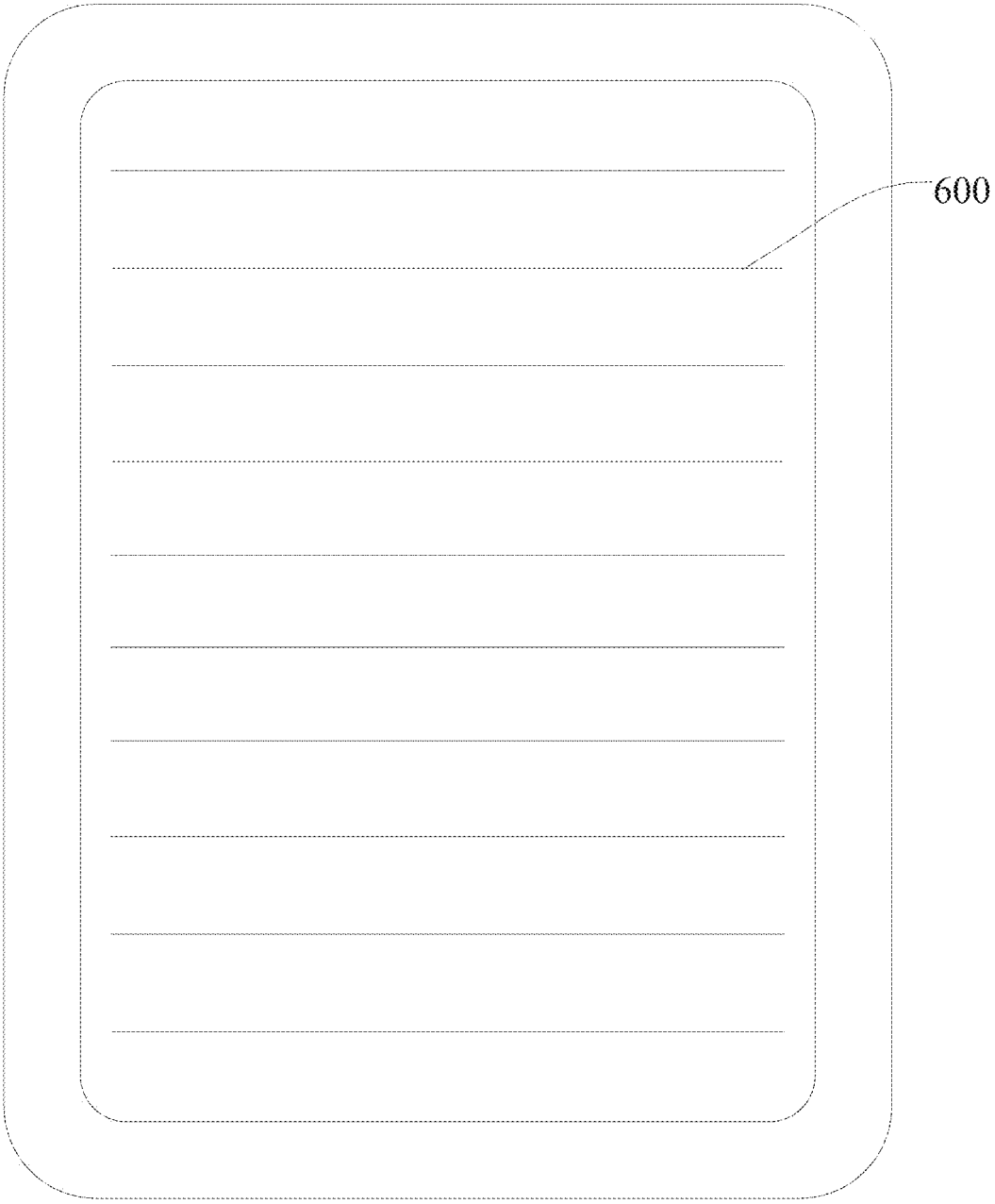
FIG. 16 is a bottom view of the inflatable mattress of FIG. 11.

FIGS. 14 to 16 shows a multi-layer and multi-chamber inflatable mattress according to another embodiment. In this embodiment, the extending piece 114 is formed by extension of the third layer 113. The extending piece 114 is in a bending structure, which is gradually inclined downward from the rear-side chamber 300 to the surrounding band 120. The extending piece 114, the first layer 111, the second layer 112 and the surrounding band 120 are enclosed to form the upper edge air chamber 410 according to the present embodiment.

In this embodiment, the face-side chambers 200 are in air communication each other. The first passage 710 of the pump 700 runs through the upper edge air chamber 410 and is in air communication with the face-side chambers 200. The second passage 720 is in air communication with the bottom edge air chamber 510. In addition, the second layer 112 is provided with an opening 340, through which the face-side chamber 200 is in air communication with the rear-side chamber 300. The pump 700 in the present embodiment thus can inflate the face-side chambers 200, the rear-side chamber 300, the upper edge air chamber 410, the bottom edge air chamber 510, and the mattress body 100.

In combination with FIG. 14 and FIG. 16, the drawing bands 600 in this embodiment are in sheet shape. The drawing bands 600 are gradually inclined outward from the top panel 110 to the bottom panel 130 of the inflatable mattress from the middle to both sides, i.e., the angle formed by the drawing bands 600 arranged closer to the middle of the mattress body with respect to the bottom panel 130 more tends to be a right angle.

The extending piece 114 can be formed by extension of the second layer 112, or extension of the third layer 113, or co-extension of the second layer 112 and the third layer 113 after connected.

Figure 17:
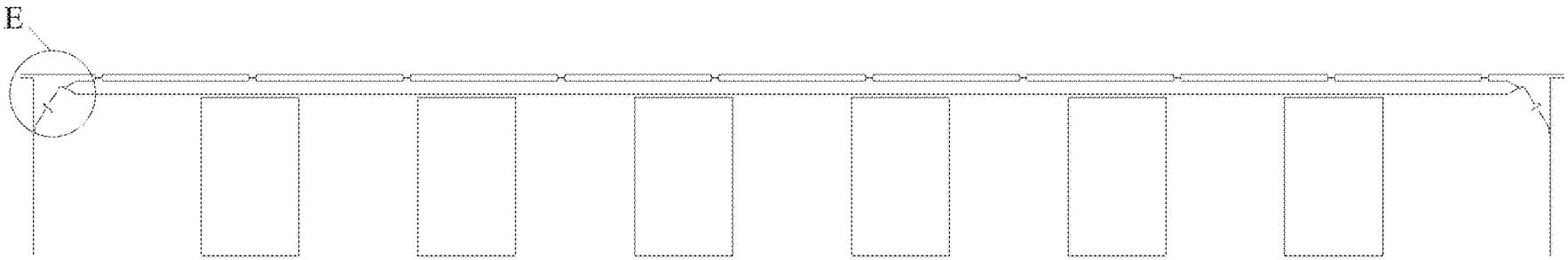
FIG. 17 is a cross-sectional view of an inflatable mattress along the length direction thereof according to an embodiment of the present invention.
Figure 18:
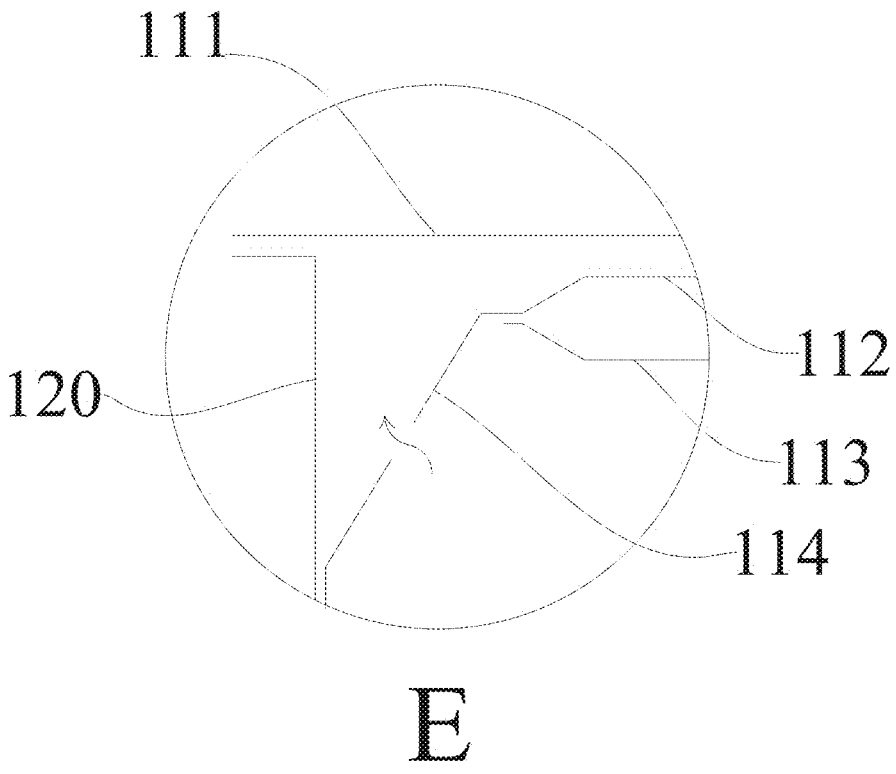
FIG. 18 is an enlarge view of detail E of FIG. 17.

The extending piece 114 in the embodiment of FIG. 17 and FIG. 18 is formed by extension of the second layer 112. In this embodiment, the upper edge air chamber 410 is formed by the extending piece 114, the first layer 112, the second layer 112, and the surrounding band 120.

Figure 19:
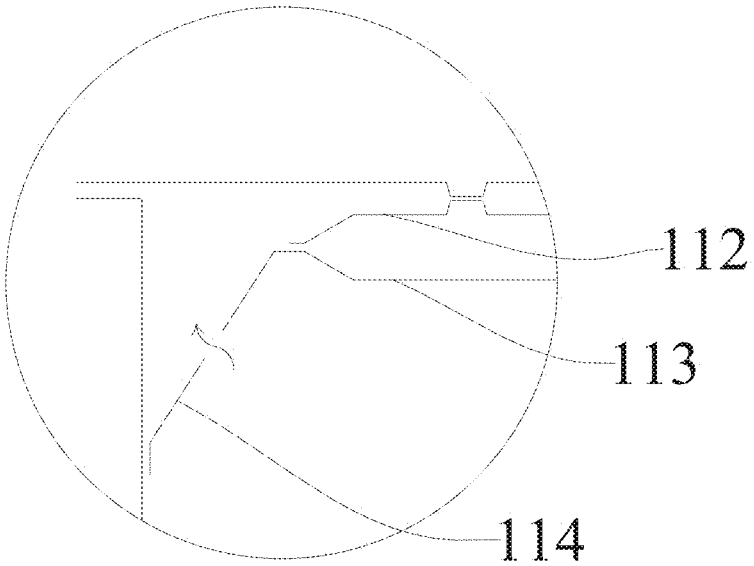
FIG. 19 is a partially enlarged view of an inflatable mattress according to an embodiment of the present invention.

The extending piece 114 in the embodiment of FIG. 19 is formed by extension of the third layer 113. In this embodiment, the upper edge air chamber 410 is formed by the extending piece 114, the first layer 112, the second layer 112, and the surrounding band 120.

Figure 20:
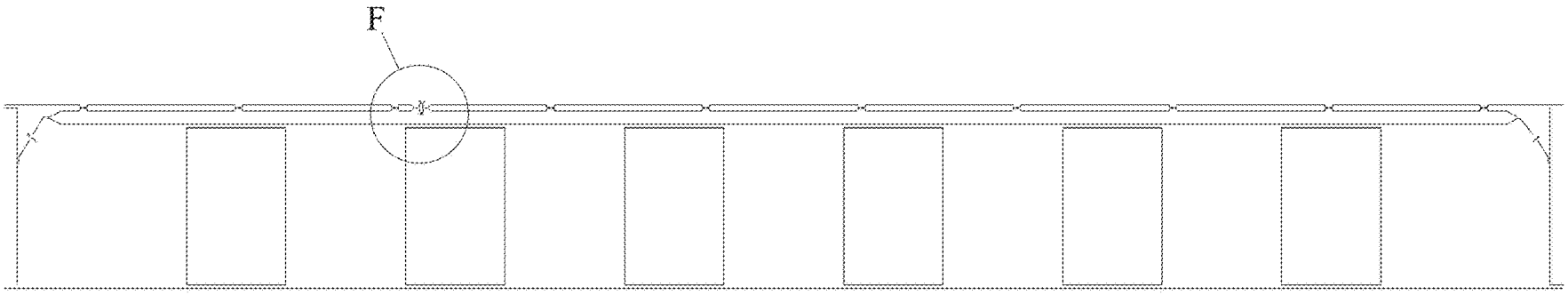
FIG. 20 is a cross-sectional view of an inflatable mattress along the length direction thereof according to an embodiment of the present invention.
Figure 21:
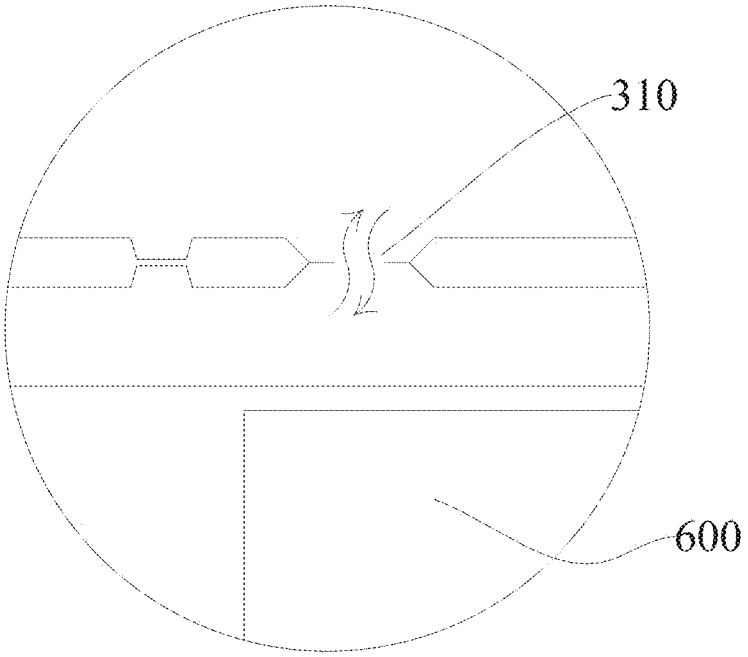
FIG. 21 is an enlarge view of detail F of FIG. 20.

The embodiment of FIGS. 20 and 21 has same structure with FIG. 17 shown. In this embodiment, the joint of the first layer 111 and the second layer 112, especially avoiding the face-side chambers 200, is additionally provided with the natural vent hole 310, through which the rear-side chamber 300 is in air communication with the outside of the mattress.

Figure 22:
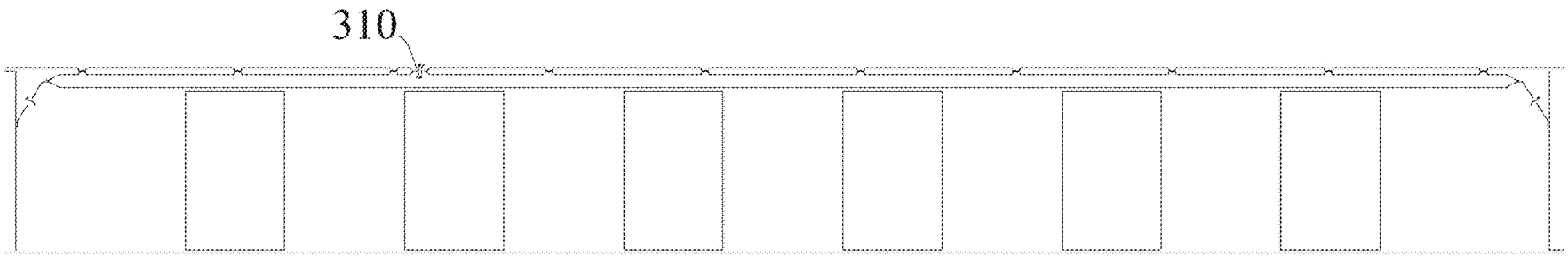
FIG. 22 is a cross-sectional view of an inflatable mattress along the length direction thereof according to an embodiment of the present invention.

The embodiment of FIG. 22 has same structure with FIG. 19. In this embodiment, the joint of the first layer 111 and the second layer 112, especially avoiding the face-side chambers 200, is additionally provided with the natural vent hole 310, through which the rear-side chamber 300 is in air communication with the outside of the mattress.

Figure 23:
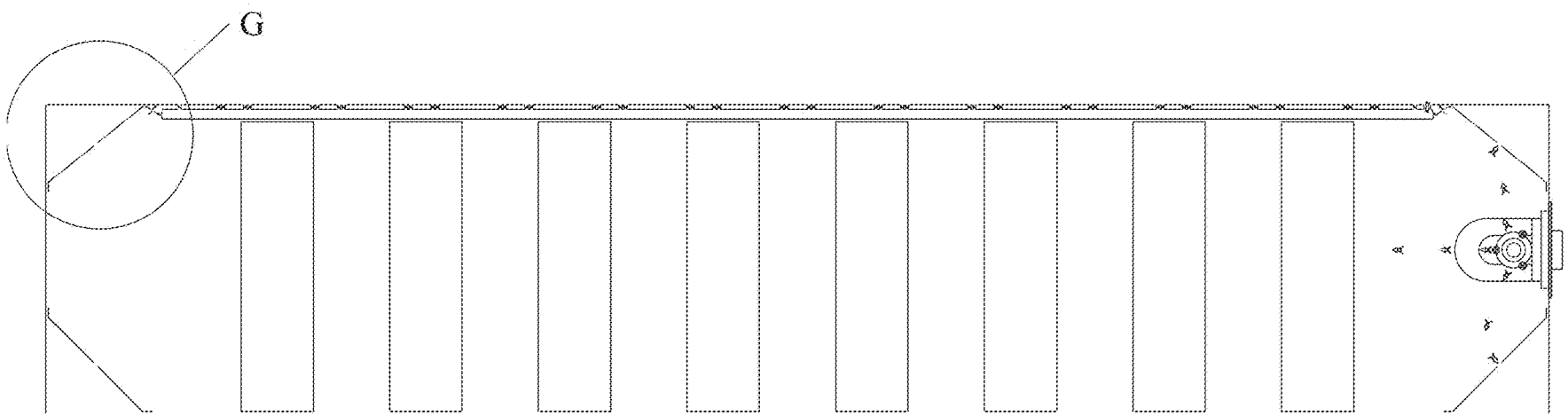
FIG. 23 is a cross-sectional view of an inflatable mattress along the length direction thereof according to an embodiment of the present invention.
Figure 24:
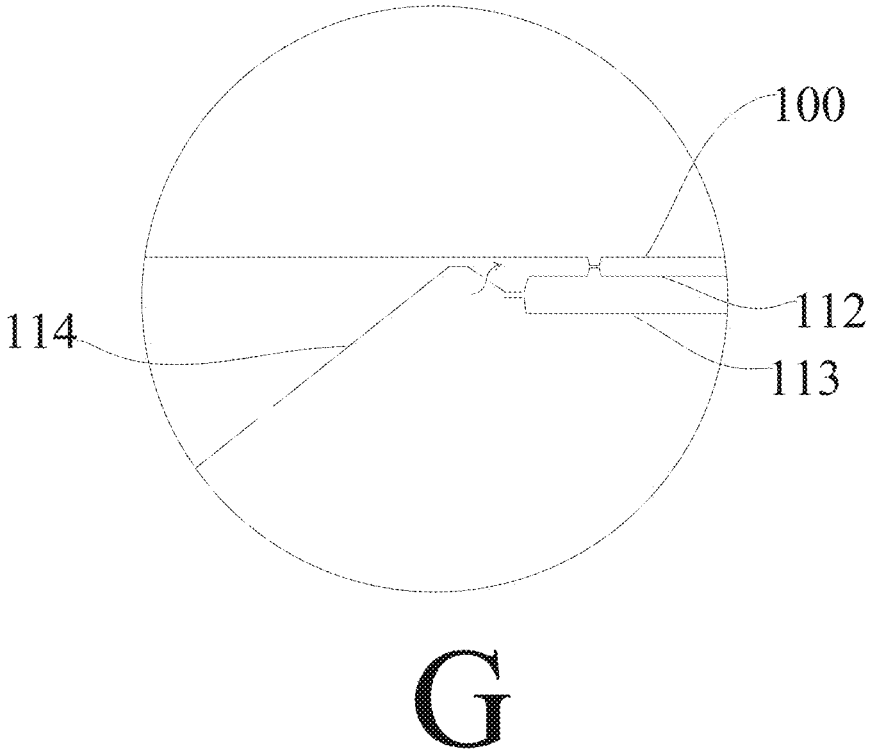
FIG. 24 is an enlarge view of detail G of FIG. 23.

Referring now to FIGS. 23 and 24, in the embodiment the first layer 111 is connected to the surrounding band 120, the edge of the second layer 112 is connected to the edge of the third layer 113, the joint of the second layer 112 and the third layer 113 is extended to form the extending piece 114, and the extending piece 114, the first layer 111, and the surrounding band 120 are enclosed to form the upper edge air chamber 410.

Figure 25:
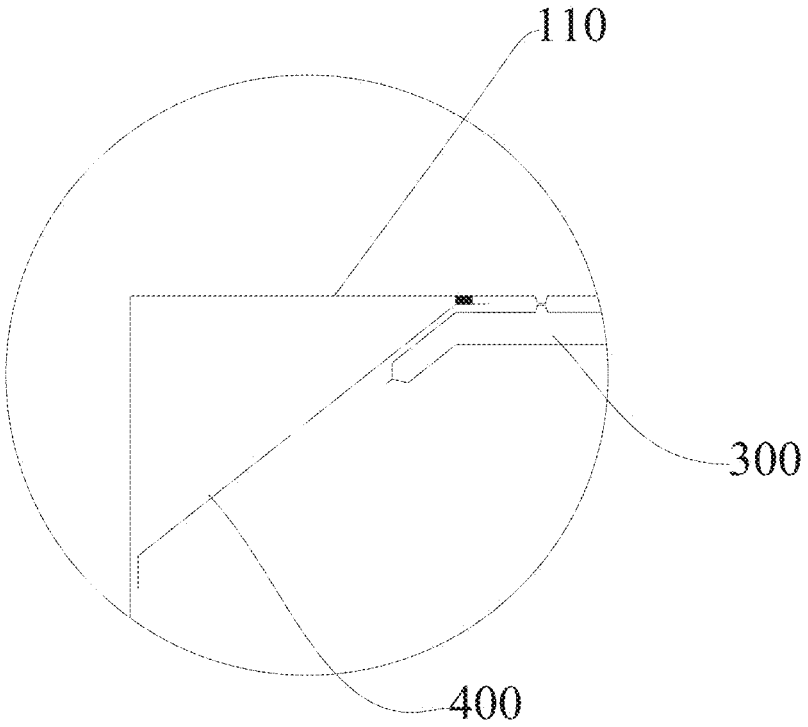
FIG. 25 is a partially enlarged view of an inflatable mattress according to an embodiment of the present invention.

FIG. 25 a view similar to FIG. 24 but showing an alternative embodiment, instead of the extending piece 114, the upper encircling piece 400 is provided at the top panel 110 and joined to the top panel 110. In this embodiment, the first layer 111, the upper encircling piece 400, and the surrounding band 120 are enclosed to form the upper edge air chamber 410, and the edge of the rear-side chamber 300 is formed along the upper encircling piece 400.

Figure 27:
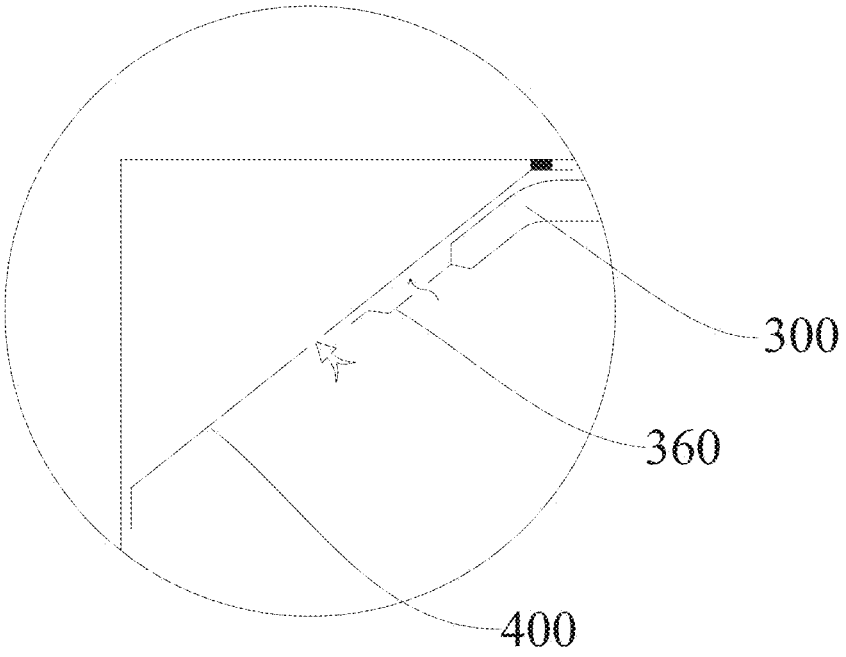
FIG. 27 is a partially enlarged view of an inflatable mattress according to an embodiment of the present invention.

In this case, a limiting piece 360 can be further provided, referring to FIG. 27. One side of the limiting piece 360 is joined to the edge of the rear-side chamber 300 and the opposite side thereof is joined to the upper encircling piece 400. Additionally, the limiting piece 360 can be provided with a limiting vent hole. The limiting piece 360 in this embodiment provides limitation to the rear-side chamber 300. Specifically, the limiting piece 360 will be pulled down to limit expansion of the rear-side chamber 300 during inflating, thereby making the surface of the mattress flatter and smoother.

Figure 26:
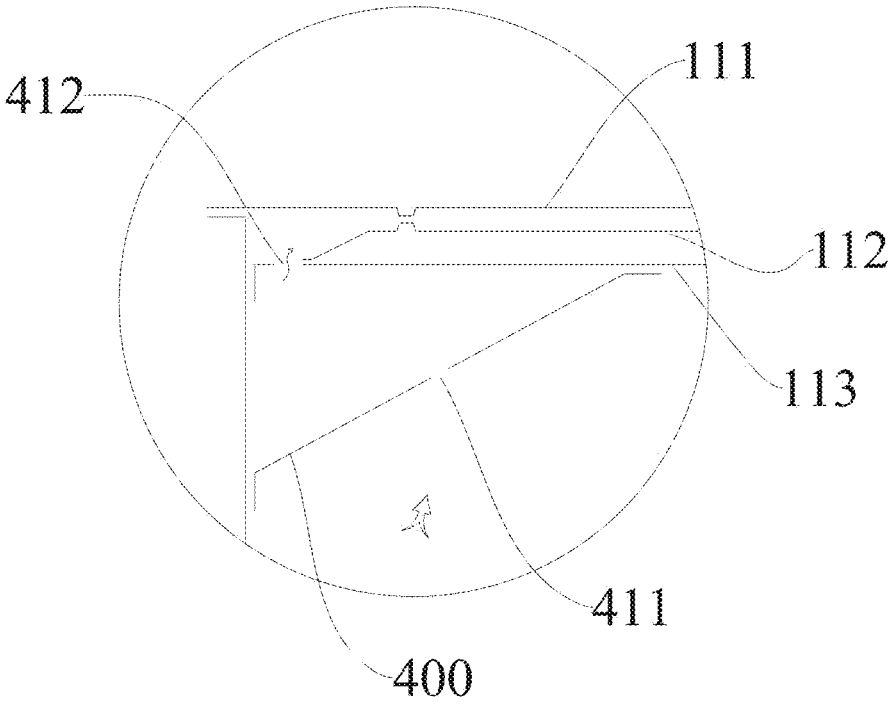
FIG. 26 is a partially enlarged view of an inflatable mattress according to an embodiment of the present invention.

FIG. 26 is a view similar to FIG. 24 but showing a further alternative embodiment. The first layer 111 is joined to the surrounding band 120, the edge of the second layer 112 is joined to the third layer 113, and the edge of the third layer 113 is joined to the surrounding band 120. In this embodiment, the upper encircling piece 400 is provided inside the mattress body, one side of the upper encircling piece 400 is joined to the third layer 113, and the opposite side thereof is joined to the surrounding band 120. In this embodiment, the upper encircling piece 400, the top panel 110 and the surrounding band 120 are enclosed to form the upper edge air chamber 410. In addition, the face-side chambers 200 are in air communication with each other, and the third layer 113 is provided with a layer vent hole 412, through which the face-side chambers 200 are in air communication with the upper edge air chamber 410.

Referring now to FIGS. 28 to 31, a multi-layer and multi-chamber inflatable mattress is further provided according to an embodiment of the present invention, which includes a backrest as will be described in greater detail.

Figure 28:
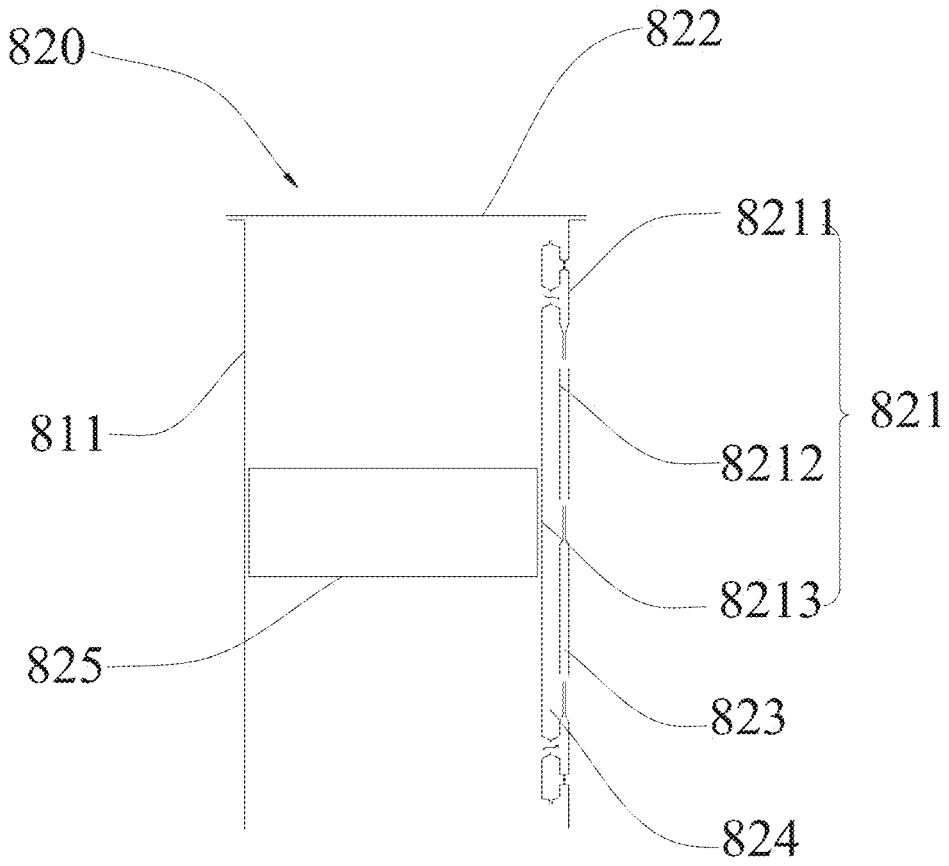
FIG. 28 is a cross-sectional view of a backrest along the length direction thereof according to an embodiment of the present invention.

FIG. 28 schematically depicts structure of the backrest according to an embodiment, which includes a support body 800. The support body 800 has a back support layer 821 which is close to the user. The back support layer 821 includes a first support layer 8211 and a second support layer 8212, which are joined to each other to form a plurality of front-side support chambers 823. The back support layer 821 may further include a third support layer 8213. The second support layer 8212 and the third support layer 8213 are joined to each other to form a reinforced chamber 824 which can be provided with a natural vent hole to allow it to be in air communication with the outside of the support body 800 or not. Preferably, the reinforced chamber 824 is not provided with a vent hole.

Similar to the mattress body 100, the front-side support chambers 823 at least includes a first front-side support chamber and a second front-side support chamber with different shapes or different size, which are connected to each other.

The support body 800 in this embodiment particularly includes only one back support 820 which is defined by a rear layer 811, a side layer 822 and the back support layer 821. The side layer 822 is both joined to the rear layer 811 and the back support layer 821. Particularly, at least one drawing band 825 is provided inside the back support 820, which is connected to the back support layer 821 and the rear layer 811. The drawing band 825 mentioned can be in sheet shape or columnar shape.

Material of the first support layer 8211 may be flock/PVC or comfortable and breathable fabric/PVC. Material of the second support layer 8212, the third support layer 8213, and the drawing band 825 may be flock/PVC, PVC, TPU or formed by one of them bonding with a fabric. Material of the rear layer 811 may be PVC, TPU or formed by one of them bonding with a fabric.

Figure 29:
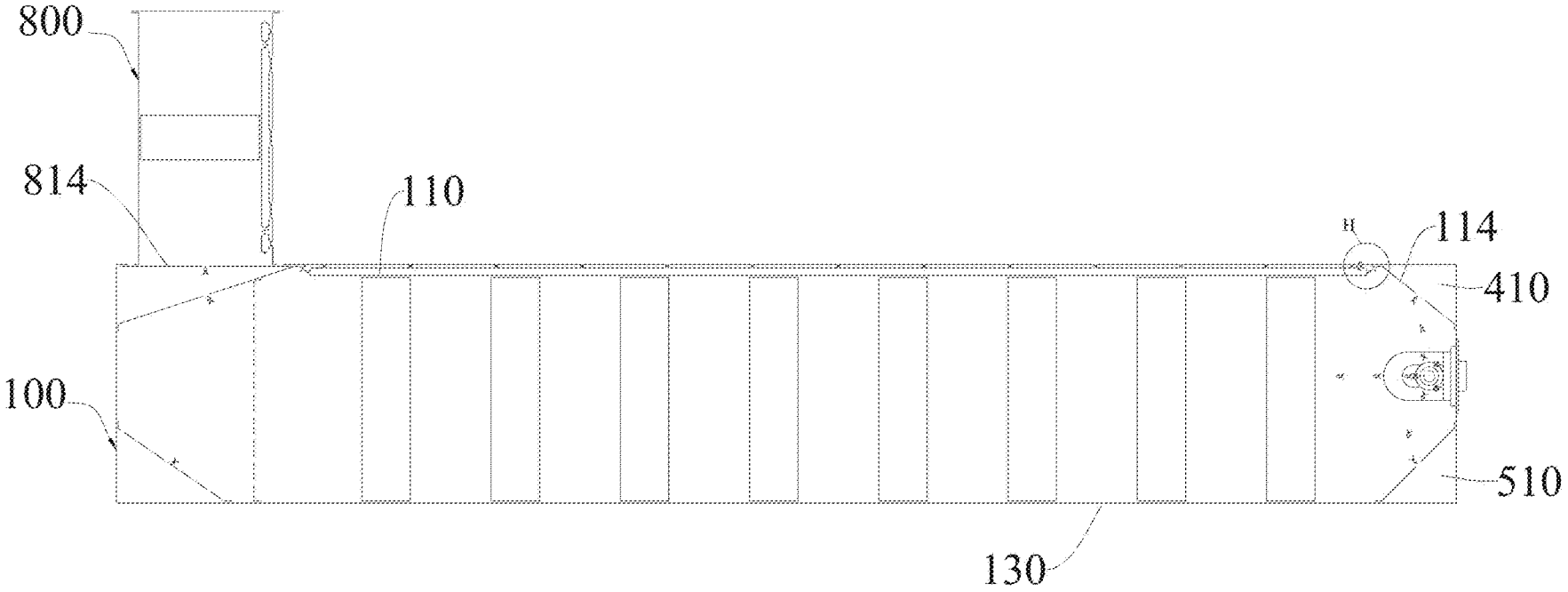
FIG. 29 a cross-sectional view of an inflatable mattress along the length direction thereof according to an embodiment of the present invention, with the backrest of FIG. 28.

FIG. 29 shows the support body 800 connected to the mattress body 100. In this embodiment, the support body 800 is connected to the mattress body 100 through a top panel supplement piece 814 at one side of the mattress body 100. Particularly, the bottom ends of the rear layer 811 and the support layer 821, especially the first support layer 8211, are joined to the top panel supplement piece 814. The support layer 821, the side layer 822, the rear layer 811, and the top panel supplement piece 814 are enclosed to form the backrest.

Figure 30:
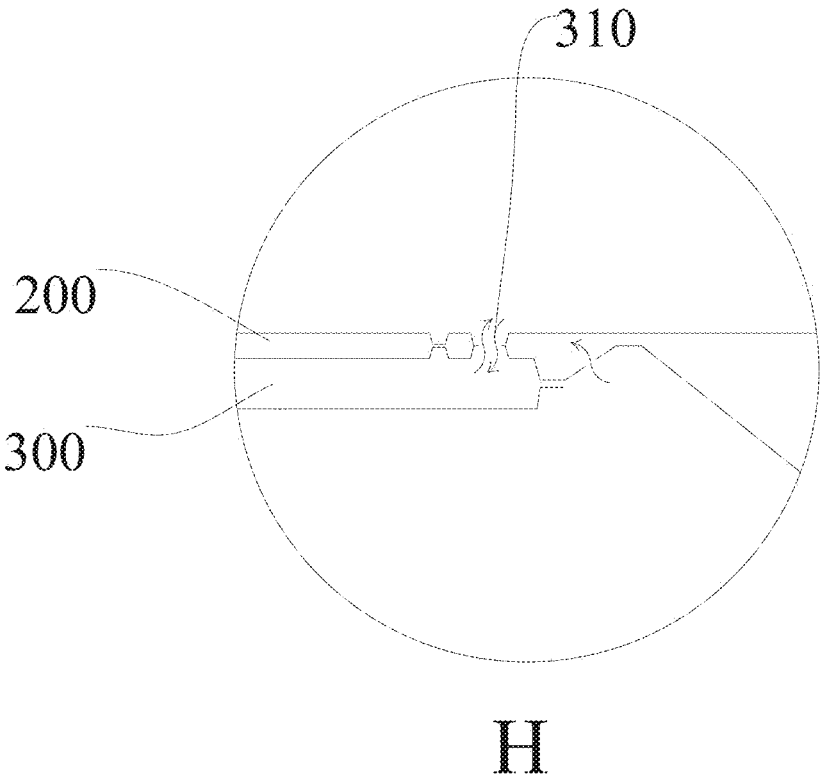
FIG. 30 is an enlarge view of detail H of FIG. 29.
Figure 31:
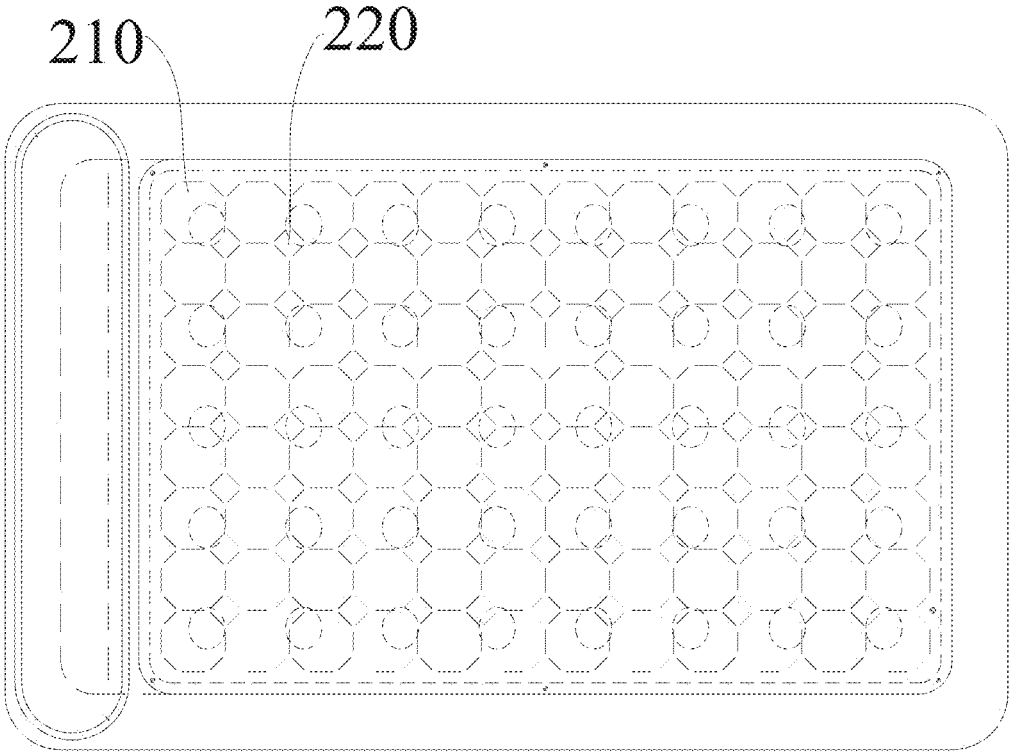
FIG. 31 is a top view of the inflatable mattress of FIG. 29.

Referring now to FIGS. 30 and 31, the top panel 110 includes a first layer 111 and a second layer 112 laid below the first layer 111, at least one of the first layer 111 and the second layer 112 is joined to the surrounding band 120, and the first layer 111 and the second layer 112 are joined to form a plurality of face-side chambers 200. The top panel 110 may further include a third layer 113 which is joined to the second layer 112 to form a rear-side chamber 300. The face-side chambers 200 include first face-side chambers 210 and second face-side chambers 220 which are connected to each other in air communication or not. The first face-side chambers 210 and second face-side chambers 220 have different size or shapes and uniformly distribute to form different shaped patterns on the top panel 110. Preferably, the first face-side chambers 210 and the second face-side chambers 220 are alternatively distributed, making the overall appearance of the mattress more pleasing.

The rear-side chamber 300 can be provided with a nature vent hole or not. In this embodiment a nature vent hole 310 is provided. In such case, the area of the rear-side chamber 300 is larger than the total area of all the face-side chambers 210, 220, and the nature vent hole 310 is provided at a portion of the rear-side chamber 300 avoiding the face-side chambers 210, 220, such nature vent hole 310 is in air communication with the outside of the mattress body 100.

The first layer 111 is joined to the surrounding band 120, the edge of the second layer 112 is joined to the edge of the third layer 113, the joint of the second layer 112 and the third layer 113 extends towards the surrounding band 120 to form an extending piece 114, namely an upper encircling piece. It should be noted that the extending piece 114 can be formed by extension of the second layer 112, or extension of the third layer 113, or common extension of the second layer 112 and the third layer 113. In this embodiment, the extending piece 114 is formed by extension of the second layer 112. The extending piece 114, the first layer 111, and the surrounding band 120 are enclosed to form an upper edge air chamber 410. In addition, a bottom encircling piece 500 can be further provided. In this embodiment, the bottom panel 130 is joined to the surrounding band 120, one side of the bottom encircling piece 500 is joined to the bottom panel 130 and the other side thereof is joined to the surrounding band 120 so that the bottom encircling piece 500, the bottom panel 130, and the surrounding band 120 are enclosed to form a bottom edge air chamber 510. A plurality of drawing bands 600 are provided in the mattress body 100, with one end connected with the top panel 110 and the other end connected with the bottom panel 130. The drawing bands 600 can be in sheet shape or columnar shape. Additional drawing bands may also be provided between the extending piece 114 and the bottom panel 130.

Material of the first layer 111 may be flock/PVC or comfortable and breathable fabric/PVC. Material of the second layer 112, the third layer 113, and the drawing bands 600 may be flock/PVC, PVC, TPU or formed by one of them bonding with a fabric. Material of the bottom layer 130 may be PVC, TPU or formed by one of them bonding with a fabric.

The top panel supplement piece 814, the extending piece 114 and the bottom encircling piece 500 are individually provided with a hole for air passing, so that the back support 820 is in air communication with the upper edge air chamber 410, and the upper edge air chamber 410 and the bottom edge air chamber 510 are in air communication with the inside of the mattress body. A bump 700 is provided at one side of the surrounding band 120 opposite to the support body 800, which is configured to inflate the mattress body 100 and the support body 800.

Figure 32:
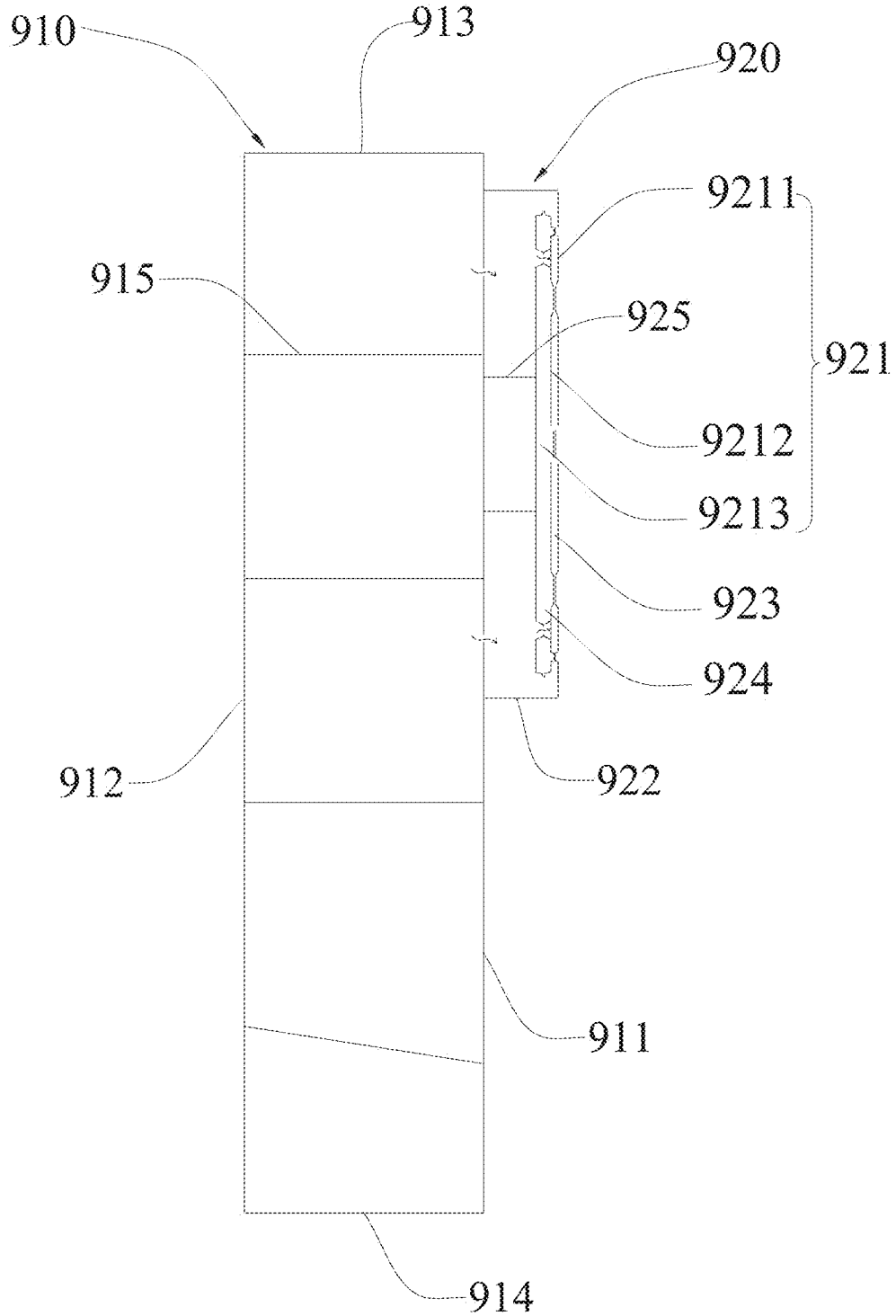
FIG. 32 is a cross-sectional view of a backrest along the length direction thereof according to another embodiment of the present invention.
Figure 33:
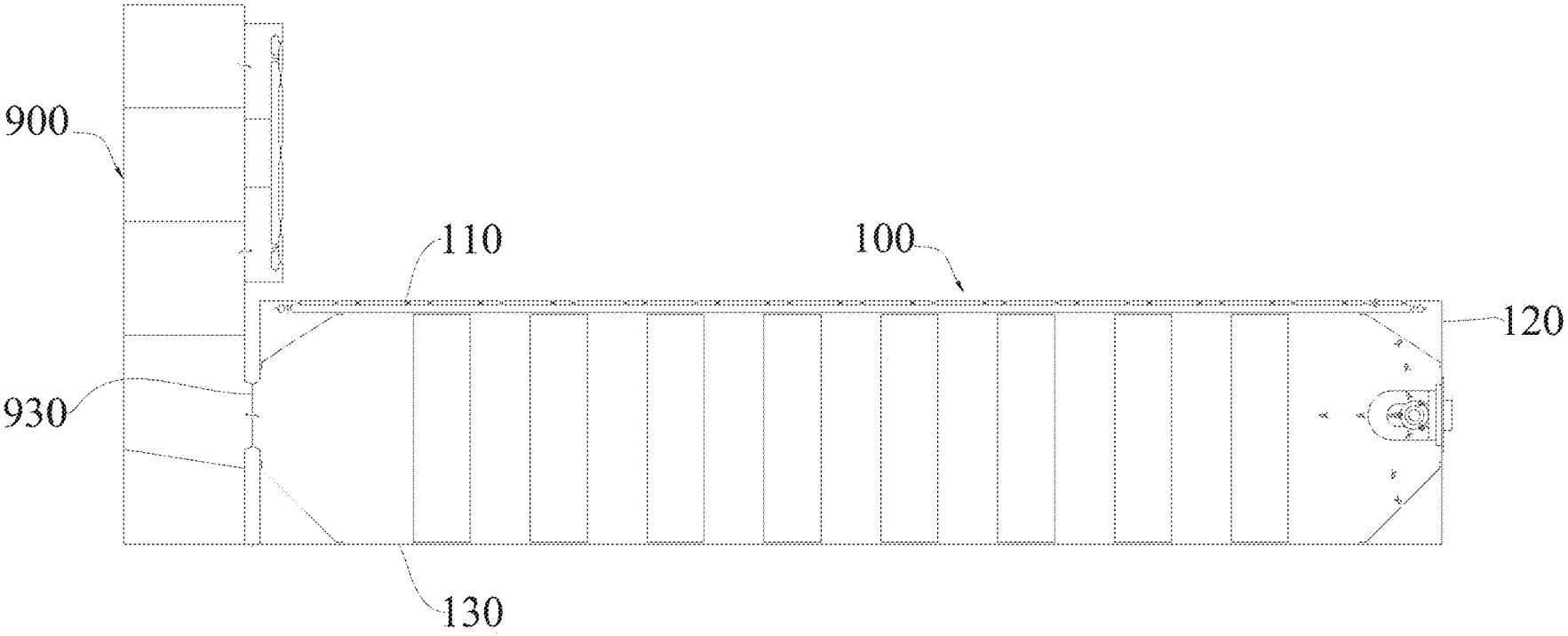
FIG. 33 a cross-sectional view of an inflatable mattress along the length direction thereof according to an embodiment of the present invention, with the backrest of FIG. 32.

FIG. 32 and FIG. 33 provides an inflatable mattress according to another embodiment of the present invention, in which a backrest is connected to the mattress body, as will be described in greater detail.

Referring to FIG. 32, the backrest has a support body 900 in this embodiment which includes two back supports of a first back support 910 and a second back support 920. The first back support 910 is enclosed and defined by a front layer 911, a rear layer 912, a first side layer 913, and a backrest bottom layer 914, wherein the first side layer 913 and the backrest bottom layer 914 individually joined to the front layer 911 and rear layer 912 together at the upper end and the bottom end of the first back support 910. The second back support 920 is enclosed and defined by a back support layer 921, a second side layer 922, and the front layer 911, wherein the second side layer 922 is joined to the back support layer 921 and the front layer 911 at the upper end and the bottom end of the second back support 920. The back support layer 921 particularly includes a first support layer 9211 and a second support layer 9212, which are joined to each other to form a plurality of front-side support chambers 923. The back support layer 921 may further include a third support layer 9213. The second support layer 9212 and the third support layer 9213 are joined to each other to form a reinforced chamber 924.

Similarly, the front-side support chambers 923 at least includes a first front-side support chamber and a second front-side support chamber with different shapes or different size, which are connected to each other.

At least one first drawing band 915 is provided inside the first back support 910, which connects the front layer 911 and rear layer 912. At least one second drawing band 925 is provided inside the second back support 920, which connects the back support layer 921 and the front layer 911. The first drawing band 915 and the second drawing band 925 can be in sheet shape or columnar shape. In the present embodiment, the drawing band is in columnar shape.

Material of the first support layer 9211 may be flock/PVC or comfortable and breathable fabric/PVC. Material of the second support layer 9212, the third support layer 9213, and the drawing bands 915, 925 may be flock/PVC, PVC, TPU or formed by one of them bonding with a fabric. Material of the rear layer 912 may be PVC, TPU or formed by one of them bonding with a fabric.

In order to allow the first back support 910 to be in air communication with the second back support 920, the front layer 911 corresponding to the second back support 920 is provided with a plurality of vent holes.

FIG. 33 shows how the backrest is connected to the mattress body 100. In this embodiment, portion of the surrounding band 120 and the front layer 911 are joined together by welding to form a welding piece 930. The welding piece 930 is provided with a hole to make the first back support 910 in air communication with the mattress body 100.

The mattress body 100 in this embodiment substantially has same structure as FIG. 29 shown. An upper encircling piece 400 is provided inside of the mattress body 100, instead of the extending piece 114 in FIG. 29. The upper encircling piece 400, the surrounding band 120 and the top panel 110 are enclosed to form the upper edge air chamber 410. A bottom encircling piece 500 is further provided inside of the mattress body, and the bottom encircling piece 500, the surrounding band 120 and the bottom panel 130 are enclosed to form the bottom edge air chamber 510. In addition, one side of the upper encircling piece 400 is connected to the third layer 113 and the other opposite side is connected to the surrounding band 120. The rear-side chamber 300 extends to the inside of the upper edge air chamber 410 and close to the surrounding band 120.

Please be noted that the method of connecting or joining two elements in the present invention is by heat weld or bonding, unless otherwise specified. The arrows shown in the drawings indicate the flow direction of air.

Obviously, the above-mentioned embodiments of the present invention are only examples for clearly illustrating the technical solution of the present invention, rather than limiting the specific implementation modes of the present invention. Any modifications, equivalent replacements and improvements made within the spirit and principles of the claims of the present invention shall be included within the protection scope of the claims of the present invention.

What is claimed is:

1. A multi-layer and muti-chamber inflatable mattress, comprises a mattress body enclosed by a top panel, a surrounding band, and a bottom panel, wherein the top panel comprises a first layer and a second layer laid below the first layer, wherein at least one of the first layer and the second layer is joined to the surrounding band, and the first layer is joined to the second layer to form a plurality of face-side chambers, wherein the face-side chambers comprise a plurality of first face-side chambers and second face-side chambers which are joined to each other;

wherein the top panel further comprises a third layer which is joined to the second layer to form a rear-side chamber; and wherein a nature vent hole is additionally provided at the rear-side chamber avoiding the plurality of face-side chambers, through which the rear-side chamber is in air communication with an outside of the mattress body, and an area of the rear-side chamber is larger than a total area of all the plurality of face-side chambers.

2. The multi-layer and muti-chamber inflatable mattress according to claim 1, wherein the third layer is formed by two or more separate layers, and each separate layer is joined to the second layer to form one rear-side chamber.

3. The multi-layer and muti-chamber inflatable mattress according to claim 1, wherein one or more elastic elements are provided in the rear-side chamber, with one end of the one or more elastic elements connected to the second layer and another end thereof connected to the third layer.

4. The multi-layer and muti-chamber inflatable mattress according to claim 1, wherein the first layer is joined to the surrounding band, an edge of the second layer is joined to an edge of the third layer, a joint of the second layer and the third layer is extended towards the surrounding band to form an extending piece, the extending piece, the first layer, and the surrounding band are enclosed to form an upper edge air chamber; and a bottom encircling piece is further provided, the bottom encircling piece, the bottom panel, and the surrounding band are enclosed to form a bottom edge air chamber.

5. The multi-layer and muti-chamber inflatable mattress according to claim 4, wherein a pump is provided at the surrounding band for inflating the mattress body, which is connected with a first air passage in air communication with the upper edge air chamber and a second air passage in air communication with the bottom edge air chamber.

6. The multi-layer and muti-chamber inflatable mattress according to claim 1, wherein the first layer is joined to the surrounding band, the second layer and the third layer are joined each other at an edge, and at the edge the second layer or the third layer is extended to form an extending piece in a way that the extending piece, the first layer, the second layer and the surrounding band are enclosed to form an upper edge air chamber; and a bottom encircling piece is further provided, the bottom encircling piece, the bottom panel and the surrounding band are enclosed to form a bottom edge air chamber.

7. The multi-layer and muti-chamber inflatable mattress according to claim 6, wherein a pump is provided at the surrounding band for inflating the mattress body, which is connected with a first air passage running through the upper edge air chamber to be in air communication with the face-side chambers and a second air passage in air communication with the bottom edge air chamber.

8. The multi-layer and muti-chamber inflatable mattress according to claim 1, wherein the first layer is joined to the surrounding band, the second layer and the third layer are joined each other at an edge, and at the edge the second layer or the third layer is extended to form an extending piece in a way that the extending piece, the first layer, and the surrounding band are enclosed to form an upper edge air chamber.

9. The multi-layer and muti-chamber inflatable mattress according to claim 1, wherein the top panel is provided with an upper encircling piece, where the first layer, the upper encircling piece and the surrounding band are enclosed to form an upper edge air chamber, and an edge of the rear-side chamber is formed along the upper encircling piece.

10. The multi-layer and muti-chamber inflatable mattress according to claim 9, wherein a limiting piece is provided with one edge joined to an edge of the rear-side chamber and an opposite side joined to the upper encircling piece, and the limiting piece is provided with a limiting vent hole.

11. The multi-layer and muti-chamber inflatable mattress according to claim 1, wherein the first layer is joined to the surrounding band, an edge of the second layer is joined to the third layer, and an edge of the third layer is joined to the surrounding band; an upper encircling piece is provided inside the mattress body, the upper encircling piece, the top panel and the surrounding band are enclosed to form an upper edge air chamber; and the plurality of face-side chambers are in air communication with each other, the third layer is provided with a layer vent hole, through which the plurality of face-side chambers are in air communication with the upper edge air chamber.

12. The multi-layer and muti-chamber inflatable mattress according to claim 11, wherein a bottom encircling piece is further provided, where the bottom encircling piece, the bottom panel, and the surrounding band are enclosed to form a bottom edge air chamber, both the upper encircling piece and the bottom encircling piece are provided with a through hole through which the upper edge air chamber and the bottom edge air chamber are in air communication with the inside of the mattress body.

13. The multi-layer and muti-chamber inflatable mattress according to claim 1, wherein a pump is provided at the surrounding band for inflating the mattress body.

14. The multi-layer and muti-chamber inflatable mattress according to claim 1, wherein a backrest with a support body is further comprised which is joined to the mattress body, the support body has a back support layer which comprises a first support layer and a second support layer, where the first support layer and the second support layer are joined to each other to form a plurality of front-side support chambers.

15. The multi-layer and muti-chamber inflatable mattress according to claim 14, wherein the back support layer further comprises a third support layer, and the second support layer and the third support layer are joined to each other to form a reinforced chamber.

16. The multi-layer and muti-chamber inflatable mattress according to claim 15, wherein the support body comprises one back support, which is defined by a rear layer, a side layer and the back support layer, the side layer is both joined to the rear layer and the back support layer.

17. The multi-layer and muti-chamber inflatable mattress according to claim 16, wherein the support body comprises two back supports of a first back support and a second back support, where the first back support is enclosed by a front layer, a rear layer, a first side layer and a backrest bottom layer, and the second back support is enclosed by the back support layer, a second side layer and the front layer.

* * * * *